US009535346B2

(12) United States Patent
Sekiya et al.

(10) Patent No.: US 9,535,346 B2
(45) Date of Patent: Jan. 3, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Michiyo Sekiya, Atami (JP); Yota Ito, Mishima (JP); Nobuhiro Nakamura, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/568,714

(22) Filed: Dec. 12, 2014

(65) Prior Publication Data

US 2015/0185636 A1 Jul. 2, 2015

(30) Foreign Application Priority Data

Dec. 26, 2013 (JP) ..... 2013-270562
Dec. 4, 2014 (JP) ..... 2014-246017

(51) Int. Cl.
*G03G 5/14* (2006.01)

(52) U.S. Cl.
CPC ..... *G03G 5/14* (2013.01); *G03G 5/142* (2013.01)

(58) Field of Classification Search
CPC ..... G03G 5/142; G03G 5/14
USPC ..... 430/60, 63, 65, 62, 64
See application file for complete search history.

(56) References Cited

U.S. PATENT DOCUMENTS 4,948,690 A * 8/1990 Hisamura ..... G03G 5/142 430/59.6
5,455,135 A 10/1995 Maruyama et al.
6,268,095 B1 7/2001 Kuroda
2007/0026332 A1* 2/2007 Ferrar ..... G03G 5/102 430/64
2015/0185630 A1 7/2015 Ito et al.
2015/0185634 A1 7/2015 Sekiya et al.
(Continued)

FOREIGN PATENT DOCUMENTS

JP 2003-330209 A 11/2003
JP 3717320 B2 11/2005
(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Fitzpatrick, Cella, Harper & Scinto

(57) ABSTRACT

An electrophotographic photosensitive member has an undercoat layer containing a polymerized product of a composition including electron transporting substance having a polymerizable functional group and a crosslinking agent, and resin particles. The content of the electron transporting substance is 30% by mass or more and 70% by mass or less based on the total mass of the composition. Protrusions derived from the resin particles in the undercoat layer are formed at an interface between the undercoat layer and the charge generating layer.

10 Claims, 1 Drawing Sheet

(56) References Cited

U.S. PATENT DOCUMENTS

| | | | |
|---|---|---|---|
| 2015/0185635 | A1 | 7/2015 | Noguchi et al. |
| 2015/0185638 | A1 | 7/2015 | Nakamura et al. |

FOREIGN PATENT DOCUMENTS

| | | | | |
|---|---|---|---|---|
| JP | 2010-145506 | A | 7/2010 | |
| WO | WO 2012002516 | A1 * | 1/2012 | ..... G03G 5/0607 |

OTHER PUBLICATIONS

Yamashita, et al. (eds.), "Crosslinking Agent Handbook", Taiseisha, Ltd., 1981, pp. 536-605.

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including an electrophotographic photosensitive member.

Description of the Related Art

Process cartridges and electrophotographic apparatuses are provided with electrophotographic photosensitive members, and currently mostly employ electrophotographic photosensitive members containing organic photoconductive substances. The electrophotographic photosensitive member typically includes a support and a photosensitive layer formed on the support. Between the support and the photosensitive layer, an undercoat layer is provided to suppress injection of charges from the support to the photosensitive layer (charge generating layer) to prevent generation of image defects such as fogging and cover defects on the surface of the support.

Some known undercoat layers contain electron transporting substances to suppress drawing of electrons from a charge generating layer and suppress injection of charges from the support to the charge generating layer. Such undercoat layers containing electron transporting substances have higher resistance and suppress the injection of charges from the support to the charge generating layer more significantly than undercoat layers utilizing conductive ions or metal oxide particles do.

Japanese Patent Application Laid-Open No. 2010-145506 describes an undercoat layer (electron transporting layer) including only a binder resin and a tetracarboxylic acid imide compound as an electron transporting material. The undercoat layer has high mobility and suppresses the injection of charges significantly. Since the electron transporting substance is soluble in a solvent, the electron transporting material may be eluted into the charge generating layer or a coating solution when the charge generating layer is formed on the undercoat layer by coating, particularly by immersion coating. For this reason, the undercoat layer cannot attain its intrinsic electron transportability, leading to insufficient electron moving ability in some cases.

This leads to techniques of crosslinking the electron transporting substance. Japanese Patent Application Laid-Open No. 2003-330209 describes an undercoat layer containing a polymerized product of an electron transporting substance having a non-hydrolyzable polymerizable functional group.

Such an undercoat layer can suppress the elution of the electron transporting substance by crosslinking thereof. Unfortunately, the crosslinking may cause insufficient drawing of electrons to stagnate charges, leading to insufficient sensitivity.

There has been plenty of room for improvement in formation of an undercoat layer having high electron moving ability without eluting an electron transporting substance when the charge generating layer is formed on the undercoat layer by coating.

SUMMARY OF THE INVENTION

An object of the present invention is to provide an electrophotographic photosensitive member that suppresses injection of charges from the support to the charge generating layer and has improved sensitivity, and a process cartridge and an electrophotographic apparatus, each including the electrophotographic photosensitive member.

The present invention is an electrophotographic photosensitive member including: a support, an undercoat layer formed on the support, a charge generating layer formed directly on the undercoat layer, and a hole transporting layer formed on the charge generating layer, wherein the undercoat layer includes:

a polymerized product of a composition containing an electron transporting substance having a polymerizable functional group, and a crosslinking agent, and resin particles, wherein the content of the electron transporting substance is 30% by mass or more and 70% by mass or less based on the total mass of the composition, and a plurality of protrusions derived from the resin particles in the undercoat layer is formed at an interface between the undercoat layer and the charge generating layer.

The present invention also relates to a process cartridge integrally supporting the electrophotographic photosensitive member and at least one device selected from the group consisting of a charging device, a developing device and a cleaning device, the process cartridge being attachable to and detachable from an electrophotographic apparatus.

The present invention also relates to an electrophotographic apparatus including the electrophotographic photosensitive member, a charging device, an image exposure device, a developing device and a transfer device.

The present invention can provide an electrophotographic photosensitive member that suppresses the injection of charges from the support to the charge generating layer and has improved sensitivity, and a process cartridge and an electrophotographic apparatus including the electrophotographic photosensitive member.

Further features of the present invention will become apparent from the following description of exemplary embodiments with reference to the attached drawings.

DESCRIPTION OF THE EMBODIMENTS

Figure 1:
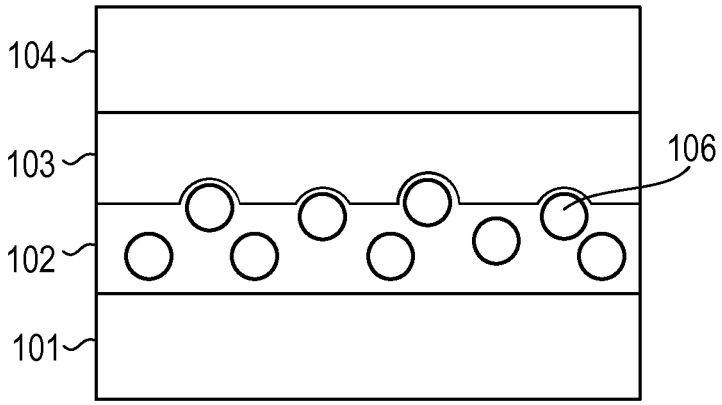
FIG. 1 is a schematic cross-sectional view for describing the undercoat layer according to the present invention.

Preferred embodiments of the present invention will now be described in detail in accordance with the accompanying drawings.

The electrophotographic photosensitive member according to the present invention includes a support, an undercoat layer formed on the support, a charge generating layer formed directly on the undercoat layer, and a hole transporting layer formed on the charge generating layer.

[Support]

The support can preferably have conductivity (electrically conductive support). For example, a support composed of a metal such as aluminum, nickel, copper, gold and iron or an alloy thereof can be used. Examples thereof further include a support having an insulating support composed of polyester resins, polycarbonate resins, polyimide resins or glass and further having a thin film of a metal such as aluminum, silver and gold formed thereon or a thin film of a conductive material such as indium oxide and tin oxide formed thereon.

The surface of the support may be subjected to an electrochemical treatment such as anode oxidation, wet honing, blasting or machining to improve electrical properties or suppress interference fringes.

[Undercoat Layer]

In the present invention, an undercoat layer is formed on the support.

The undercoat layer according to the present invention contains resin particles; and a polymerized product (cured product) of a composition including an electron transporting substance having a polymerizable functional group and a crosslinking agent. The composition of the undercoat layer may further include a thermoplastic resin having a polymerizable functional group.

The undercoat layer according to the present invention contains the resin particles, which form protrusions at the interface between the undercoat layer and the charge generating layer. The protrusions are derived from the resin particles. The resin particles are covered with the polymerized product (cured product).

In the present invention, the undercoat layer having such a configuration suppresses injection of charges from the support to the charge generating layer and has improved sensitivity. The inventors presume the reason as follows.

In an undercoat layer containing a polymerized electron transporting substance having a polymerizable functional group to suppress the elution of electron transporting substance, the sensitivity tends to be inferior to that of an undercoat layer containing a resin and an electron transporting substance (when elution does not occur). This is probably because the undercoat layer containing a polymerized product of an electron transporting substance has a crosslinking structure to reduce the injection of electrons from a charge generating substance to an electron transporting substance.

As in the present invention, if resin particles are contained in an undercoat layer having electron transportability, the resin particles can form protrusions, which can increase the probability of contact between the charge generating substance and the electron transporting substance. It seems that the increase in the contact between the charge generating substance and the electron transporting substance can compensate for a reduction in injection of electrons caused by formation of the crosslinking structure. The inventors think that these resin particles do not contribute to conductivity, and thus to injection of charges from the support to the charge generating layer, attaining compatibility between suppression of injection of charges from the support to the charge generating layer and an improvement in sensitivity.

FIG. 1 is a schematic cross-sectional view for describing the undercoat layer according to the present invention. An undercoat layer 102 is formed on a support 101, and a charge generating layer 103 is formed directly on the undercoat layer. The undercoat layer 102 contains a polymerized product of a composition including an electron transporting substance having a polymerizable functional group and a crosslinking agent. Resin particles 106 are dispersed in the undercoat layer 102. The interface between the undercoat layer and the charge generating layer has protrusions derived from the resin particles 106 in the undercoat layer.

The content of the electron transporting substance is 30% by mass or more and 70% by mass or less based on the total mass of the composition. At a content of less than 30% by mass, the resin particles, if contained, may not improve sensitivity. At a content of more than 70% by mass, elution may occur.

The content of the resin particles in the undercoat layer can be 5% by mass or more and 20% by mass or less based on the total mass of the composition. A content within this range improves sensitivity and suppresses injection of charges from the support to the charge generating layer more significantly.

The undercoat layer can be formed in the manner described below: First, a coating solution for an undercoat layer containing a composition including an electron transporting substance having a polymerizable functional group, a crosslinking agent and optionally a thermoplastic resin having a polymerizable functional group, and resin particles is used to form a coating. The coating is dried by heating to polymerize the composition to form an undercoat layer.

During drying of the coating of the coating solution for an undercoat layer by heating, the heating temperature can be 100 to 200° C.

Examples of the electron transporting substance having a polymerizable functional group include quinone compounds, imide compounds, benzimidazole compounds and cyclopentadienylidene compounds. Examples of the polymerizable functional group include a hydroxy group, a thiol group, an amino group, a carboxyl group or a methoxy group. Specific examples of the electron transporting substance include compounds represented by one of Formulae (A1) to (A11) illustrated below:

(A1)

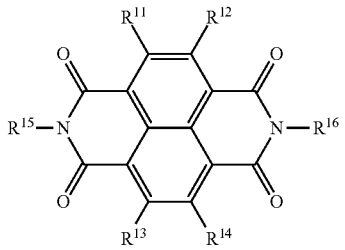

(A2)

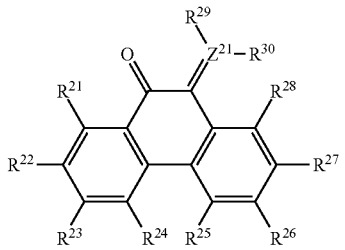

(A3)

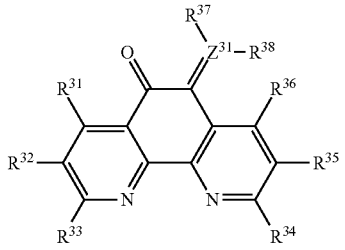

-continued (A4)

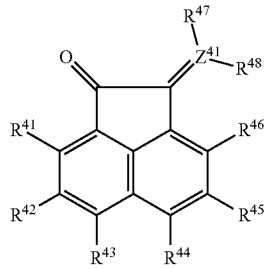

(A5)

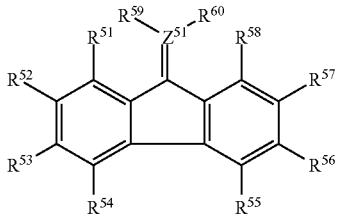

(A6)

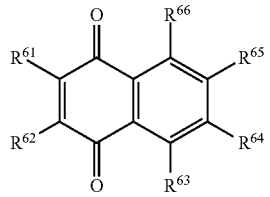

(A7)

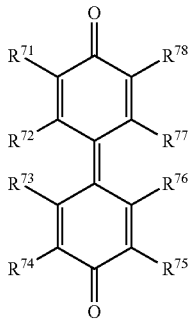

(A8)

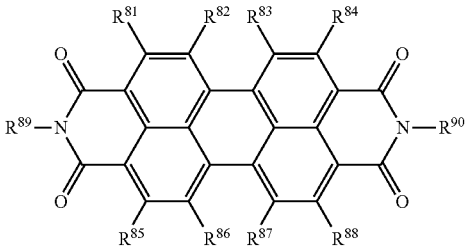

(A9)

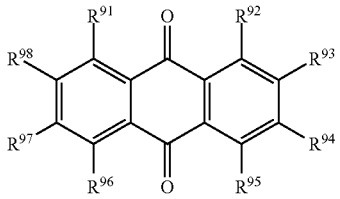

-continued (A10)

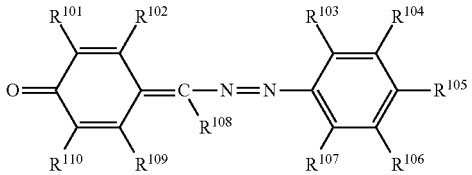

(A11)

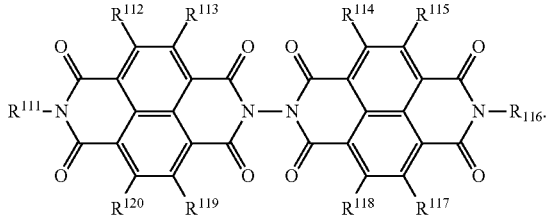

where $R^{11}$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$ and $R^{111}$ to $R^{120}$ each independently represent a monovalent group represented by Formula (A) illustrated below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocycle; one of $CH_2$'s in the main chain of the alkyl group may be replaced with O, S, NH or $NR^{121}$ where $R^{121}$ is an alkyl group; and at least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$ and at least one of $R^{111}$ to $R^{120}$ have a monovalent group represented by Formula (A);

the substituent for the substituted alkyl group is an alkyl group, an aryl group, a halogen atom or an alkoxycarbonyl group; the substituent for the substituted aryl group and the substituent for the substituted heterocyclic group are each a halogen atom, a nitro group, a cyano group, an alkyl group, a halogen-substituted alkyl group or an alkoxy group; $Z^{21}$, $Z^{31}$, $Z^{41}$ and $Z^{51}$ each independently represent a carbon atom, a nitrogen atom or an oxygen atom; where $Z^{21}$ is an oxygen atom, $R^{29}$ and $R^{30}$ are not present; where $Z^{21}$ is a nitrogen atom, $R^{30}$ is not present; where $Z^{31}$ is an oxygen atom, $R^{37}$ and $R^{38}$ are not present; where $Z^{31}$ is a nitrogen atom, $R^{38}$ is not present; where $Z^{41}$ is an oxygen atom, $R^{47}$ and $R^{48}$ are not present; where $Z^{41}$ is a nitrogen atom, $R^{48}$ is not present; where $Z^{51}$ is an oxygen atom, $R^{59}$ and $R^{60}$ are not present; and where $Z^{51}$ is a nitrogen atom, $R^{60}$ is not present;

$$-(\alpha)_l-(\beta)_m-\gamma \tag{A}$$

where at least one of α, β and γ is a group having a polymerizable functional group; the polymerizable functional group is at least one group selected from the group consisting of a hydroxy group, a thiol group, an amino group, a carboxyl group and a methoxy group; 1 and m are each independently 0 or 1; the sum of 1 and m is 0 or more and 2 or less;

α represents an alkylene group having 1 to 6 carbon atoms in the main chain, an alkylene group having 1 to 6 carbon atoms in the main chain substituted with an alkyl group having 1 to 6 carbon atoms, an alkylene group having 1 to 6 carbon atoms in the main chain substituted with a benzyl group, an alkylene group having 1 to 6 carbon atoms in the main chain substituted with an alkoxy carbonyl group, or an alkylene group having 1 to 6 carbon atoms in the main chain substituted with a phenyl group; these groups may have the polymerizable functional group; one of $CH_2$'s in the main chain of the alkylene group may be replaced with O, S or $NR^{122}$ where $R^{122}$ represents a hydrogen atom or an alkyl group;

β represents a phenylene group, a phenylene group substituted with an alkyl having 1 to 6 carbon atoms, a nitro-substituted phenylene group, a halogen group-substituted phenylene group or an alkoxy group-substituted phenylene group; these groups may have the polymerizable functional group; and γ represents a hydrogen atom, an alkyl group having 1 to 6 carbon atoms in the main chain, or an alkyl group having 1 to 6 carbon atoms in the main chain substituted with an alkyl group having 1 to 6 carbon atoms; these groups may have the polymerizable functional group; one of $CH_2$'s in the main chain of the alkyl group may be replaced with O, S or $NR^{123}$ where $R^{123}$ represents a hydrogen atom or an alkyl group.

Specific examples of the electron transporting substance having a polymerizable functional group are illustrated below. In the tables, structural units in A and Aa are represented by the same structural formulae. Specific examples of the monovalent group are illustrated in columns A and Aa. In the tables, when γ is "–," γ represents a hydrogen atom. The hydrogen atom as γ is illustrated in a structure in column α or β.

TABLE 1

| | $R^{11}$ | $R^{12}$ | $R^{13}$ | $R^{14}$ | $R^{15}$ | $R^{16}$ | A<br>α |
|---|---|---|---|---|---|---|---|
| A101 | H | H | H | H | 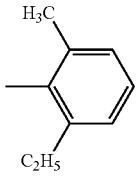 | A | 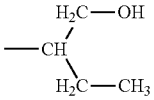 |
| A102 | H | H | H | H | 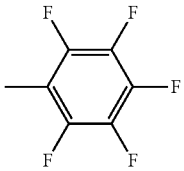 | A | 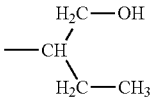 |
| A103 | H | H | H | H | 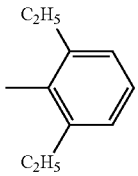 | A | — |
| A104 | H | H | H | H | 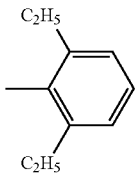 | A | — |
| A105 | H | H | H | H | 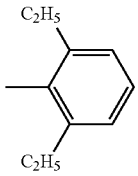 | A | 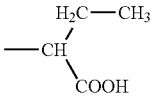 |
| A106 | H | H | H | H | A | A | 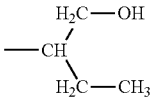 |

TABLE 1-continued
| | | | | | | | |
|---|---|---|---|---|---|---|---|
| A107 | H | H | H | H | A | A | 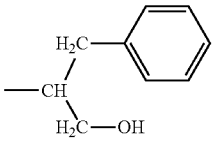 |
| A108 | H | H | H | H | 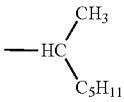 | A | 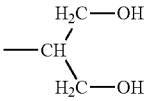 |
| A109 | H | H | H | H | 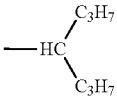 | A | 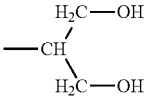 |
| A110 | H | H | H | H | 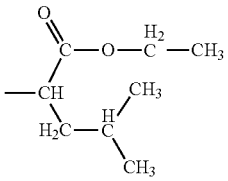 | A | 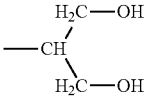 |
| A111 | H | H | H | H | 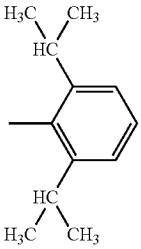 | A | 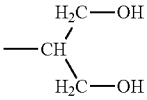 |
| A112 | H | H | H | H | 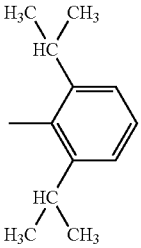 | A | 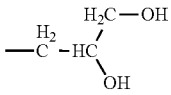 |
| A113 | H | H | H | H | A | A | 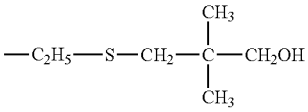 |
| A114 | H | H | H | H | A | A | 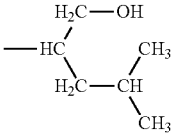 |
| A115 | H | H | H | H | A | Aa | $—C_2H_4—S—C_2H_4—OH$ |
| A116 | H | H | H | H | A | Aa | 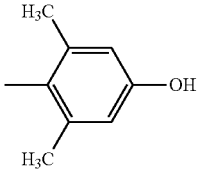 |
| A117 | H | H | H | H | A | Aa | — |
| A118 | H | H | H | H | A | Aa | — |

TABLE 1-continued

| | | | | | | | |
|---|---|---|---|---|---|---|---|
| A119 | H | H | H | H | A | Aa | $-C_2H_5-S-CH_2-C(CH_3)_2-CH_2OH$ |
| A120 | H | H | H | H | A | A | $-CH(COOH)-CH_2-CH(CH_3)_2$ |

| | A | | Aa | | |
|---|---|---|---|---|---|
| | β | γ | α | β | γ |
| A101 | — | — | — | — | — |
| A102 | — | — | — | — | — |
| A103 | $-C_6H_4-NH_2$ | — | — | — | — |
| A104 | $-C_6H_4-SH$ | — | — | — | — |
| A105 | — | — | — | — | — |
| A106 | — | — | — | — | — |
| A107 | — | — | — | — | — |
| A108 | — | — | — | — | — |
| A109 | — | — | — | — | — |
| A110 | — | — | — | — | — |
| A111 | — | — | — | — | — |
| A112 | — | — | — | — | — |
| A113 | — | — | — | — | — |
| A114 | — | — | — | — | — |
| A115 | — | — | $-CH(CH_2-C_6H_5)-CH_2-OH$ | — | — |
| A116 | — | — | $-CH(CH_2-OH)-CH_2-CH(CH_3)_2$ | — | — |
| A117 | $-C_6H_4-$ | $---CH_2-OH$ | $-CH(CH_2-OH)-CH_2-CH(CH_3)_2$ | — | — |
| A118 | $-C_6H_4-$ | $---CH_2-OH$ | $-CH(CH_2-OH)-CH_2-OH$ | — | — |

TABLE 1-continued
| | | | | | |
|---|---|---|---|---|---|
| A119 | — | — | 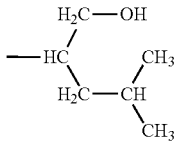 | — | — |
| A120 | — | — | — | — | — |
TABLE 2
| Exemplary compound | $R^{21}$ | $R^{22}$ | $R^{23}$ | $R^{24}$ | $R^{25}$ | $R^{26}$ | $R^{27}$ | $R^{28}$ | $R^{29}$ | $R^{30}$ | $Z^{21}$ | A α | A β | A γ |
|---|---|---|---|---|---|---|---|---|---|---|---|---|---|---|
| A201 | H | H | A | H | H | H | H | H | — | — | O | — | 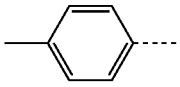 | ---$CH_2$—OH |
| A202 | H | H | H | H | H | H | H | H | A | — | N | — | 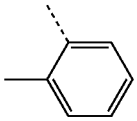 | 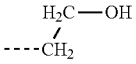 |
| A203 | H | H | 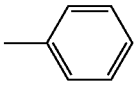 | H | H | 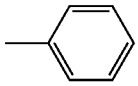 | H | H | A | — | N | — | 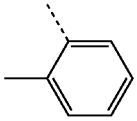 | 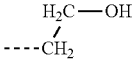 |
| A204 | H | H | 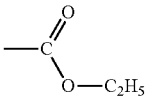 | H | H | 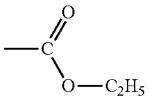 | H | H | A | — | N | — | 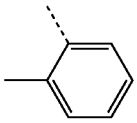 | 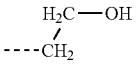 |
| A205 | H | H | A | H | H | A | H | H | — | — | O | — | 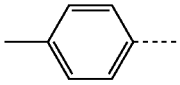 | ---$CH_2$—OH |
| A206 | H | A | H | H | H | H | A | H | — | — | O | — | 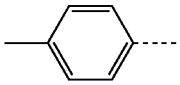 | ---$CH_2$—OH |
TABLE 3
| Exemplary compound | $R^{31}$ | $R^{32}$ | $R^{33}$ | $R^{34}$ | $R^{35}$ | $R^{36}$ | $R^{37}$ | $R^{38}$ | $Z^{31}$ | A α | A β | A γ |
|---|---|---|---|---|---|---|---|---|---|---|---|---|
| A301 | H | A | H | H | H | H | — | — | O | — | 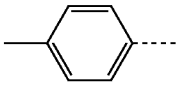 | ---$CH_2$—OH |
| A302 | H | H | H | H | H | H | A | — | N | — | 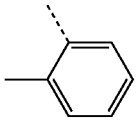 | 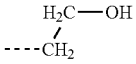 |
| A303 | H | H | H | H | H | H | A | — | N | 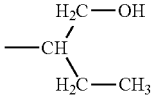 | — | — |

TABLE 3-continued

| Exemplary compound | $R^{31}$ | $R^{32}$ | $R^{33}$ | $R^{34}$ | $R^{35}$ | $R^{36}$ | $R^{37}$ | $R^{38}$ | $Z^{31}$ | A α | A β | A γ |
|---|---|---|---|---|---|---|---|---|---|---|---|---|
| A304 | H | H | Cl | Cl | H | H | A | — | N | — | 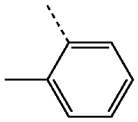 | 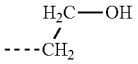 |
| A305 | H | A | H | H | A | H | CN | CN | C | — | 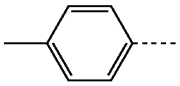 |  |

TABLE 4

| Exemplary compound | $R^{41}$ | $R^{42}$ | $R^{43}$ | $R^{44}$ | $R^{45}$ | $R^{46}$ | $R^{47}$ | $R^{48}$ | $Z^{41}$ | A α | A β | A γ |
|---|---|---|---|---|---|---|---|---|---|---|---|---|
| A401 | H | H | A | H | H | H | CN | CN | C | — | 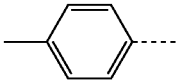 |  |
| A402 | H | H | H | H | H | H | A | — | N | — | 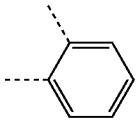 | 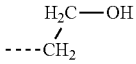 |
| A403 | H | H | A | A | H | H | CN | CN | C | — | 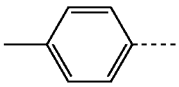 |  |
| A404 | H | H | A | A | H | H | CN | CN | C | — | 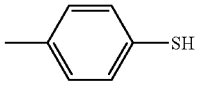 | — |
| A405 | H | H | A | A | H | H | — | — | O | — | 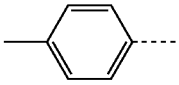 |  |

TABLE 5

| Exemplary compound | $R^{51}$ | $R^{52}$ | $R^{53}$ | $R^{54}$ | $R^{55}$ | $R^{56}$ | $R^{57}$ | $R^{58}$ | $R^{59}$ | $R^{60}$ | $Z^{51}$ | A α | A β | A γ |
|---|---|---|---|---|---|---|---|---|---|---|---|---|---|---|
| A501 | H | A | H | H | H | H | H | H | CN | CN | C | — | 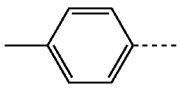 |  |
| A502 | H | $NO_2$ | H | H | $NO_2$ | H | $NO_2$ | H | A | — | N | — | 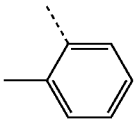 | 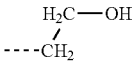 |
| A503 | H | A | H | H | H | H | A | H | CN | CN | C | 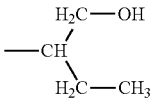 | — | — |
| A504 | H | H | A | H | H | A | H | H | CN | CN | C | — | 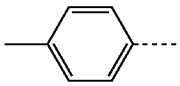 |  |

TABLE 6
| Exemplary compound | $R^{61}$ | $R^{62}$ | $R^{63}$ | $R^{64}$ | $R^{65}$ | $R^{66}$ | A α | A β | A γ |
|---|---|---|---|---|---|---|---|---|---|
| A601 | A | H | H | H | H | H | — | 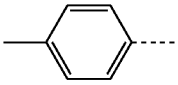 | - - -$CH_2$—OH |
| A602 | A | H | H | H | H | H | — | 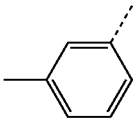 | - - -$CH_2$—OH |
| A603 | A | H | H | H | H | H | 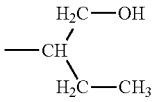 | — | — |
| A604 | A | A | H | H | H | H | — | 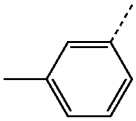 | - - -$CH_2$—OH |
| A605 | A | A | H | H | H | H | 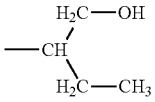 | — | — |
TABLE 7
| Exemplary compound | $R^{71}$ | $R^{72}$ | $R^{73}$ | $R^{74}$ | $R^{75}$ | $R^{76}$ | $R^{77}$ | $R^{78}$ | A α | A β | A γ | Aa α | Aa β | Aa γ |
|---|---|---|---|---|---|---|---|---|---|---|---|---|---|---|
| A701 | A | H | H | H | H | H | H | H | — | 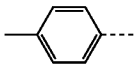 | - - -$CH_2$—OH | — | — | — |
| A702 | A | H | H | H | H | H | H | H | 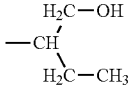 | — | — | — | — | — |
| A703 | A | H | H | H | A | H | H | H | — | 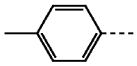 | - - -$CH_2$—OH | — | — | — |
| A704 | A | H | H | H | Aa | H | H | H | 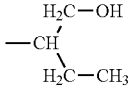 | — | — | — | 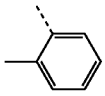 | - - -$CH_2$—OH |
| A705 | A | H | H | H | Aa | H | H | H | — | 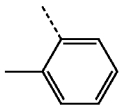 | - - -$CH_2$—OH | $-(CH_2)_5-OH$ | — | — |

TABLE 8
| Exemplary compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ |
|---|---|---|---|---|---|---|---|---|---|---|---|---|---|
| A801 | H | H | H | H | H | H | H | H | 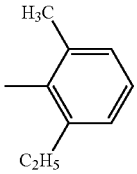 | A | 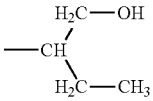 | — | — |
| A802 | H | H | H | H | H | H | H | H | 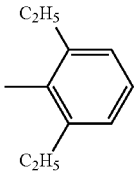 | A | — | 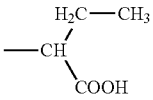 | — |
| A803 | H | CN | H | H | H | H | CN | H | 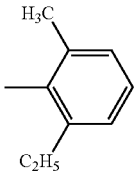 | A | 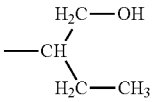 | — | — |
| A804 | H | H | H | H | H | H | H | H | A | A | 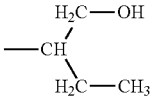 | — | — |
| A805 | H | H | H | H | H | H | H | H | A | A | — | 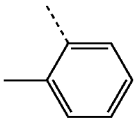 | 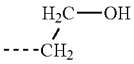 |
TABLE 9
| Exemplary compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A901 | A | H | H | H | H | H | H | H | $—CH_2—OH$ | — | — |
| A902 | A | H | H | H | H | H | H | H | $—(CH_2)_2OH$ | — | — |
| A903 | H | H | H | H | H | H | H | A | $—CH_2—OH$ | — | — |
| A904 | H | H | H | H | H | H | H | A | $—(CH_2)_2OH$ | — | — |
| A905 | H | CN | H | H | H | H | CN | A | — | 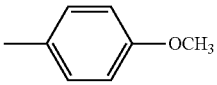 | — |
| A906 | A | A | H | $NO_2$ | H | H | $NO_2$ | H | $—(CH_2)_2OH$ | — | — |
| A907 | H | A | A | H | H | H | H | H | $—CH_2—OH$ | — | — |

TABLE 10
| Exemplary compound | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ | A α | A β | A γ |
|---|---|---|---|---|---|---|---|---|---|---|---|---|---|
| A1001 | 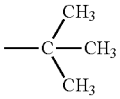 | H | H | H | A | H | H | H | H | 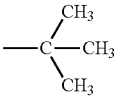 | —$CH_2$—OH | — | — |
| A1002 | 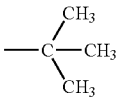 | H | H | H | A | H | H | H | H | 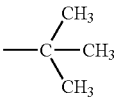 | — | 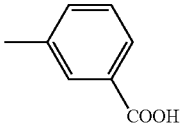 | — |
| A1003 | 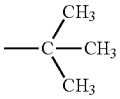 | H | H | H | A | H | H | H | H | 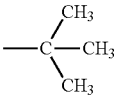 | — | 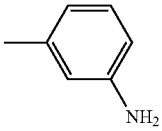 | — |
| A1004 | 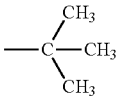 | H | H | H | A | H | H | H | H | 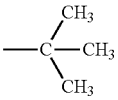 | — | 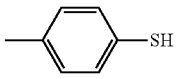 | — |
| A1005 | 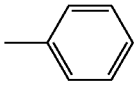 | H | H | H | A | H | H | H | H | 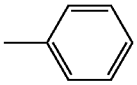 | —$CH_2$—OH | — | — |
TABLE 11
| Exemplary compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ | A α | A β | A γ |
|---|---|---|---|---|---|---|---|---|---|---|---|---|---|
| A1101 | A | H | H | H | H | A | H | H | H | H | 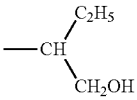 | — | — |
| A1102 | A | H | H | H | H | A | H | H | H | H | 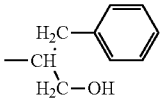 | — | — |
| A1103 | A | H | H | H | H | A | H | H | H | H | — | 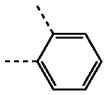 | 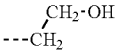 |
| A1104 | A | H | H | H | H | 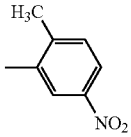 | H | H | H | H | 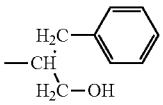 | — | — |
| A1105 | A | H | H | H | H | 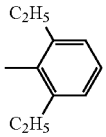 | H | H | H | H | 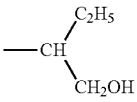 | — | — |

Derivatives having any one of structures represented by Formulae (A2) to (A6) and (A9) (derivatives of the electron transporting substance) are available from Tokyo Chemical Industry Co., Ltd., Sigma-Aldrich Japan K.K. and Johnson Matthey Japan G.K. A derivative having a structure represented by (A1) can be synthesized by reaction of naphthalene tetracarboxylic dianhydride available from Tokyo Chemical Industry Co., Ltd. or Johnson Matthey Japan G.K. with a monoamine derivative. A derivative having a structure represented by (A7) can be synthesized from a phenol derivative as a raw material available from Tokyo Chemical Industry Co., Ltd. or Sigma-Aldrich Japan K.K. A derivative having a structure represented by (A8) can be synthesized by reaction of perylene tetracarboxylic dianhydride available from Tokyo Chemical Industry Co., Ltd. or Sigma-Aldrich Japan K.K. with a monoamine derivative. A derivative having a structure represented by (A10) can be synthesized by a known synthetic method described in Japanese Patent No. 3717320 by oxidizing a phenol derivative having a hydrazone structure in an organic solvent with an appropriate oxidizing agent such as potassium permanganate. A derivative having a structure represented by (A11) can be synthesized by reaction of naphthalene tetracarboxylic dianhydride available from Tokyo Chemical Industry Co., Ltd., Sigma-Aldrich Japan K.K. or Johnson Matthey Japan G.K. with a monoamine derivative and hydrazine.

A compound represented by one of (A1) to (A11) has a polymerizable functional group (a hydroxy group, a thiol group, an amino group, a carboxyl group and a methoxy group) polymerizable with a crosslinking agent. A polymerizable functional group is introduced into a derivative having one of the structures represented by (A1) to (A11) to synthesize a corresponding compound represented by one of (A1) to (A11). Examples of the method include the following methods such as a method of synthesizing a derivative having one of the structures represented by (A1) to (A11), and then directly introducing a polymerizable functional group into the derivative; and a method of introducing a structure having a polymerizable functional group or a functional group that can serve as a precursor of the polymerizable functional group. Examples of the method include a method of introducing an aryl group having a functional group into a halide of a derivative having one of the structures represented by (A1) to (A11) by crosscoupling reaction in the presence of a palladium catalyst and a base; a method of introducing an alkyl group having a functional group into a halide of a derivative having one of the structures represented by (A1) to (A11) by crosscoupling reaction in the presence of an $FeCl_3$ catalyst and a base; and a method of lithiating a halide of a derivative having one of the structures represented by (A1) to (A11), making an epoxy compound or $CO_2$ act on the halide, and introducing a hydroxyalkyl group or a carboxyl group into the halide.

From the viewpoint of high solvent resistance and formation of a firm crosslinking structure, the electron transporting substance having a polymerizable functional group can have two or more polymerizable functional groups in the same molecule.

Next, a crosslinking agent will be described.

For the crosslinking agent, compounds polymerizable or crosslinkable with the electron transporting substance having a polymerizable functional group and a thermoplastic resin having a polymerizable functional group can be used. Specifically, compounds described in "Crosslinking Agent Handbook" (1981), edited by Shinzo Yamashita and Tosuke Kaneko, published by Taiseisha Ltd. can be used, for example.

The crosslinking agent used in the undercoat layer can be isocyanate compounds having an isocyanate group or a block isocyanate group and amine compounds having a N-methylol group or an alkyletherified N-methylol group. The isocyanate compounds can have 2 to 6 isocyanate groups or blocked isocyanate groups. Examples thereof include triisocyanate benzene, triisocyanate methylbenzene, triphenylmethane triisocyanate and lysine triisocyanate; isocyanurate modified products, biuret modified products, and allophanate modified products of diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate; and adduct modified products with trimethylolpropane and pentaerythritol. Among these, isocyanurate modified products and adduct modified products can more preferably be used.

The blocked isocyanate group has a structure —$NHCOX^1$ where $X^1$ is a protecting group. $X^1$ can be any protecting group that can be introduced into an isocyanate group. Groups represented by Formulae (H1) to (H6) illustrated below are preferred.

(H1)

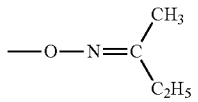

(H2)

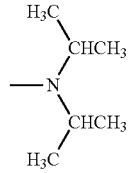

(H3)

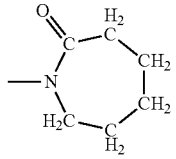

(H4)

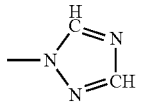

(H5)

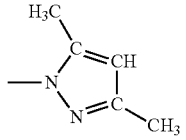

(H6)

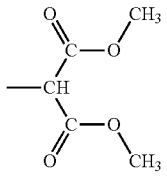

Specific examples of isocyanate compounds (B1) to (B21) are:
(B1)
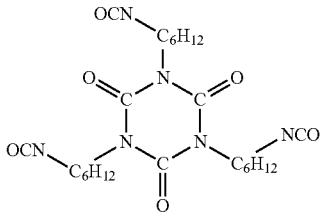
(B2)
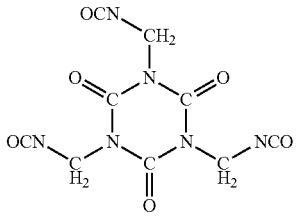
(B3)
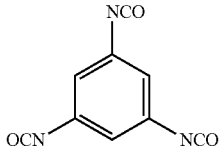
(B4)
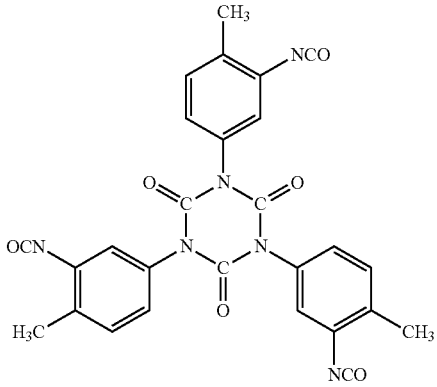
(B5)
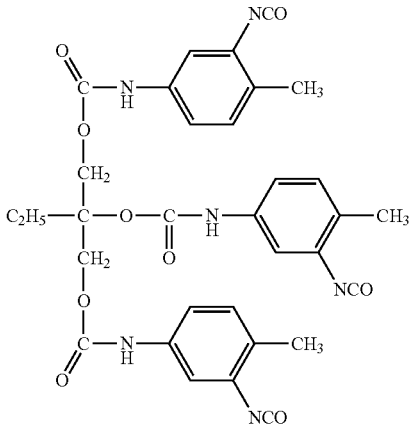
(B6)
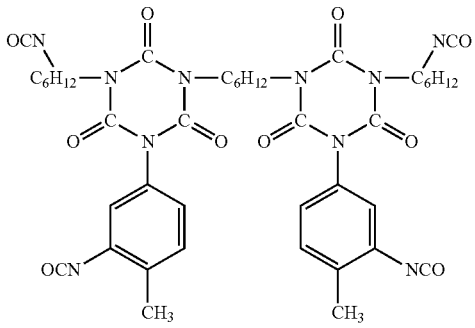
(B7)
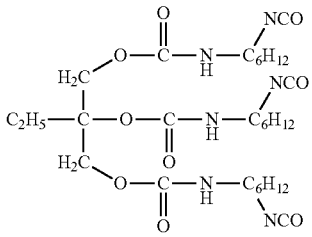
(B8)
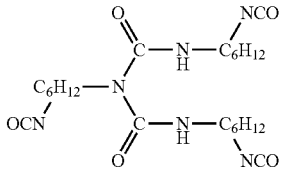

-continued
(B9)
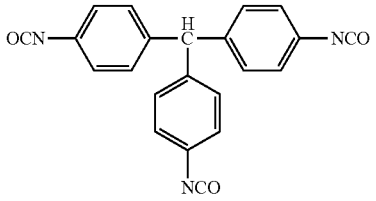
(B10)
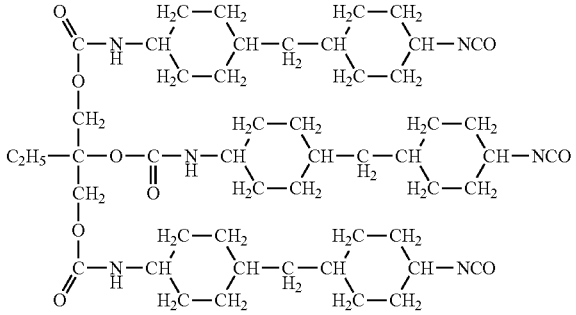
(B11)
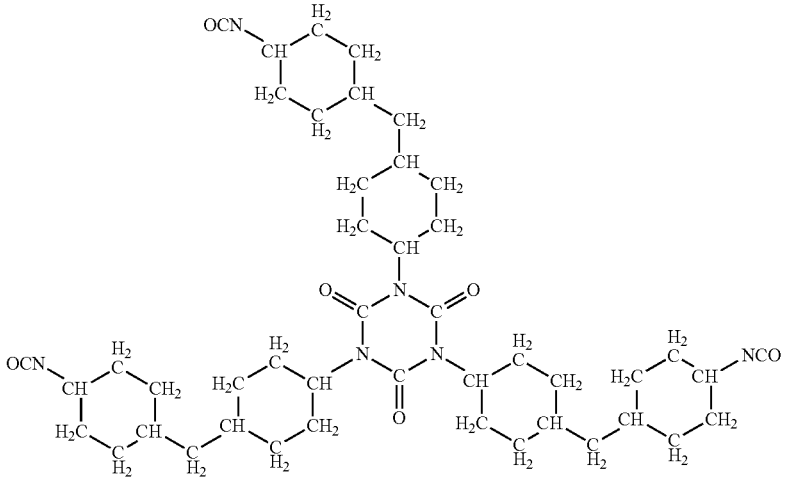
(B12)
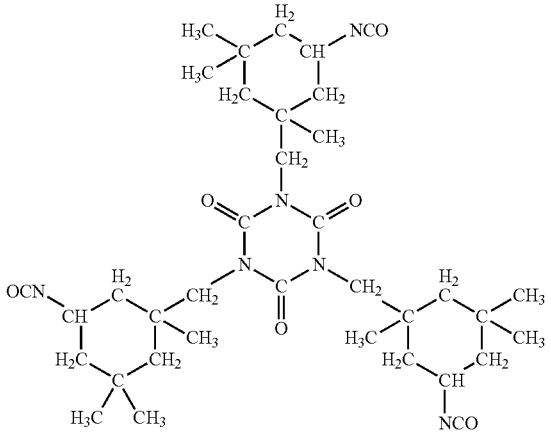
(B13)
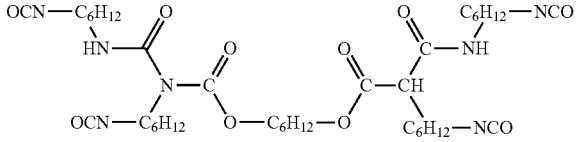

-continued
(B14)
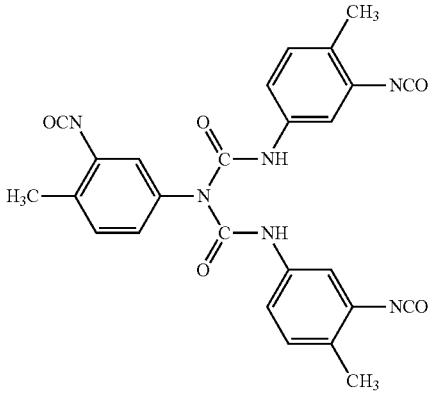
(B15)
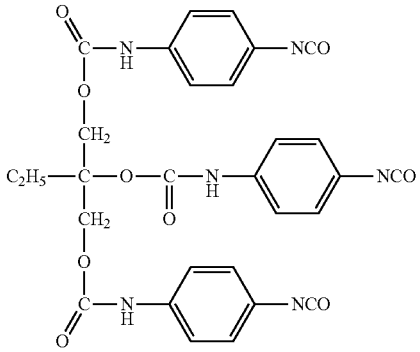
(B16)
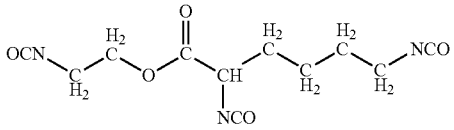
(B17)
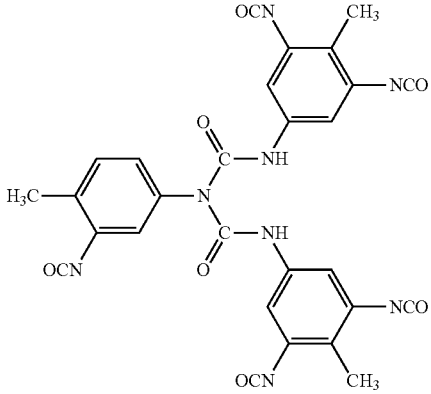
(B18)
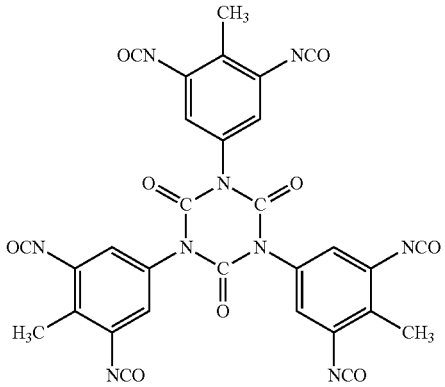
(B19)
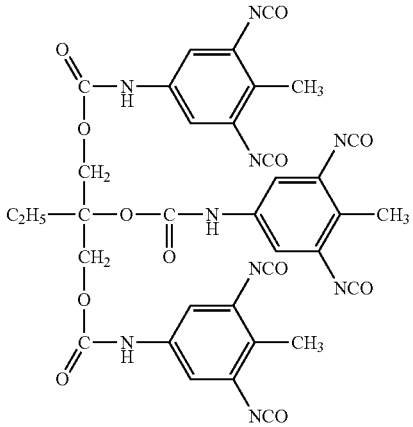
(B20)
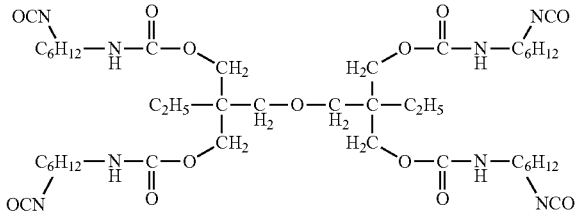
(B21)
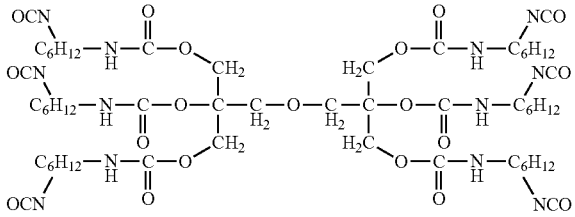

Amine compounds can have several (2 or more) N-methylol groups or alkyletherified N-methylol groups, for example. Examples of the amine compounds include melamine compounds, guanamine compounds and urea compounds. Specifically, the amine compound can be a compound represented by one of Formulae (C1) to (C5) illustrated below or an oligomer of a compound represented by one of Formulae (C1) to (C5) illustrated below.

(C1)

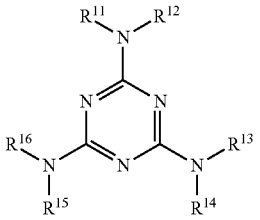

(C2)

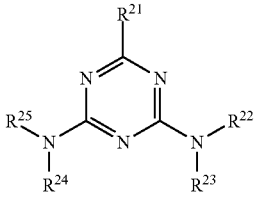

(C3)

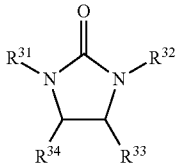

(C4)

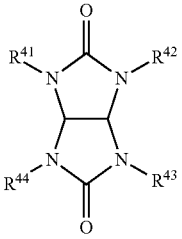

(C5)

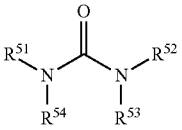

where $R^{11}$to $R^{16}$, $R^{22}$ to $R^{25}$, $R^{31}$ to $R^{34}$, $R^{41}$ to $R^{44}$ and $R^{51}$ to $R^{54}$ each independently represent a hydrogen atom, a hydroxy group, an acyl group or a monovalent group represented by —$CH_2$—$OR^1$; at least one of $R^{11}$ to $R^{16}$, at least one of $R^{22}$ to $R^{25}$, at least one of $R^{31}$ to $R^{34}$, at least one of $R^{41}$ to $R^{44}$ and at least one of $R^{51}$ to $R^{54}$ represent a monovalent group represented by —$CH_2$—$OR^1$; $R^1$ represents a hydrogen atom or an alkyl group having 1 or more and 10 or less carbon atoms where the alkyl group can be a methyl group, an ethyl group, a propyl group (n-propyl group, iso-propyl group), a butyl group (n-butyl group, iso-butyl group, tert-butyl group) or the like for polymerizability; and $R^{21}$ represents an aryl group, an alkyl group-substituted aryl group, a cycloalkyl group or an alkyl group-substituted cycloalkyl group.

Specific examples of compounds represented by one of Formulae (C1) to (C5) will be illustrated below. Examples thereof may contain oligomers (multimers) of compounds represented by one of Formulae (C1) to (C5).

The degree of polymerization of the multimers can be 2 or more and 100 or less. These multimers and monomers can be used as a mixture of two or more.

Examples of usually commercially available compounds represented by Formula (C1) illustrated above include SUPERMELAMI No. 90 (manufactured by NOF Corporation), SUPER-BECKAMINEs™ (R) TD-139-60, L-105-60, L127-60, L110-60, J-820-60 and G-821-60 (manufactured by DIC Corporation), U-VAN 2020 (Mitsui Chemicals, Inc.), SUMITEX RESIN™ M-3 (Sumitomo Chemical Co., Ltd.), and NIKALACs™ MW-30, MW-390 and MX-750LM (manufactured by Nippon Carbide Industries Co., Inc.). Examples of usually commercially available compounds represented by Formula (C2) illustrated above include SUPER-BECKAMINEs™ L-148-55, 13-535, L-145-60 and TD-126 (manufactured by DIC Corporation), and NIKALACs BL-60 and BX-4000 (manufactured by Nippon Carbide Industries Co., Inc.). Examples of usually commercially available compounds represented by Formula (C3) illustrated above include NIKALAC MX-280 (manufactured by Nippon Carbide Industries Co., Inc.). Examples of usually commercially available compounds represented by Formula (C4) illustrated above include NIKALAC MX-270 (manufactured by Nippon Carbide Industries Co., Inc.). Examples of usually commercially available compounds represented by Formula (C5) illustrated above include NIKALAC MX-290 (manufactured by Nippon Carbide Industries Co., Inc.).

Specific examples of compounds represented by Formula (C1) will be illustrated below:

(C1-1)

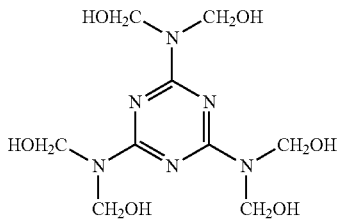

(C1-2)

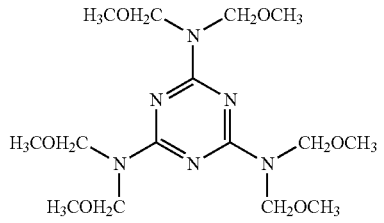

(C1-3)

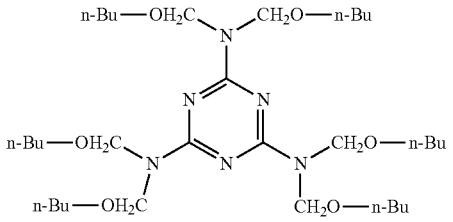

-continued
(C1-4)
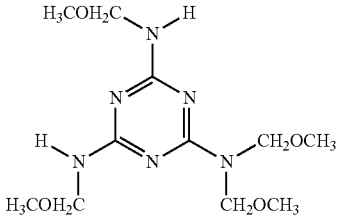
(C1-5)
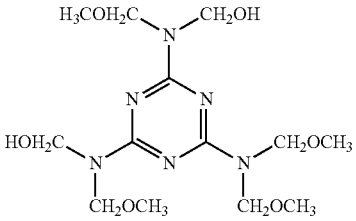
(C1-6)
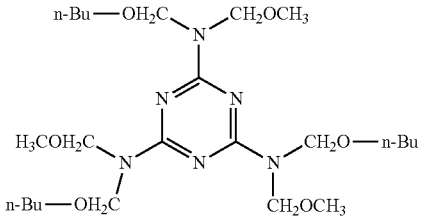
(C1-7)
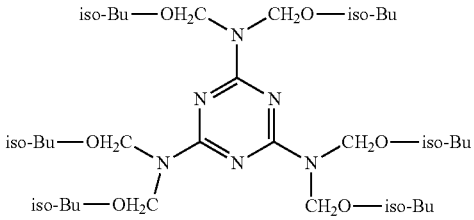
(C1-8)
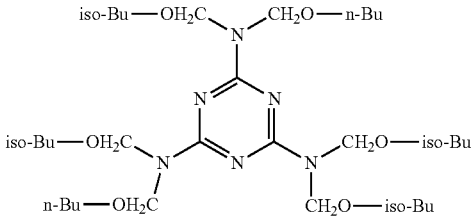
(C1-9)
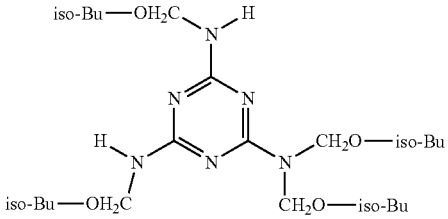
(C1-10)
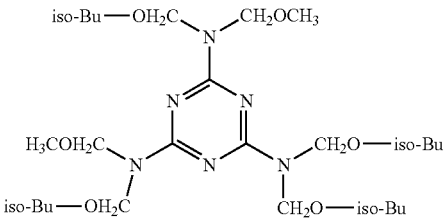
-continued
(C1-11)
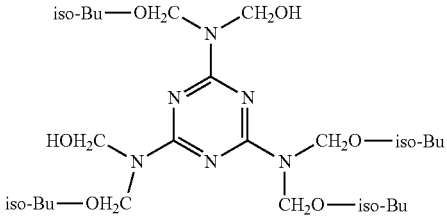
(C1-12)
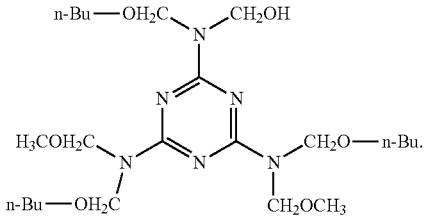
Specific examples of compounds represented by Formula (C2) will be illustrated below:
(C2-1)
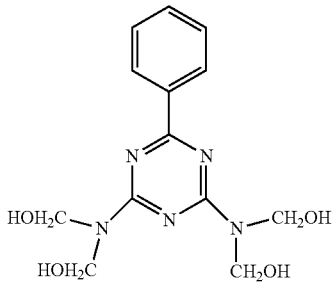
(C2-2)
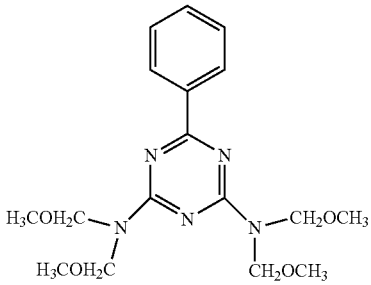
(C2-3)
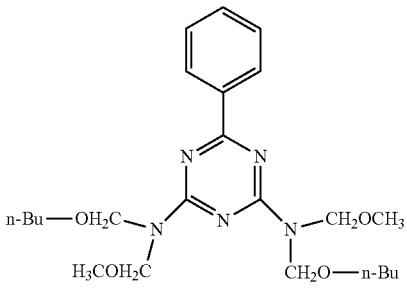

-continued
(C2-4)
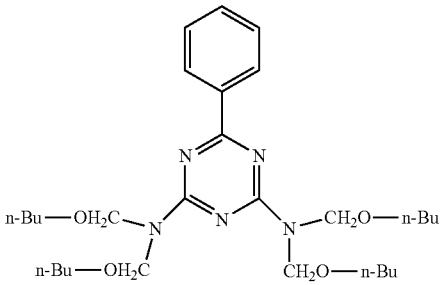
(C2-5)
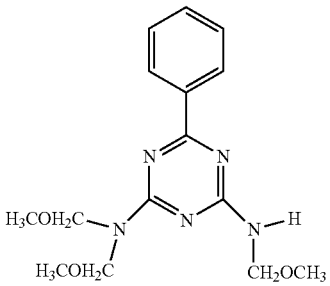
(C2-7)
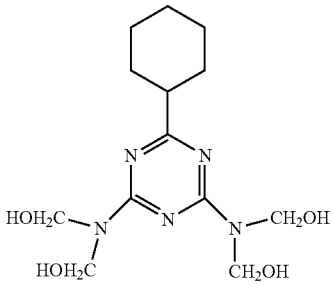
(C2-8)
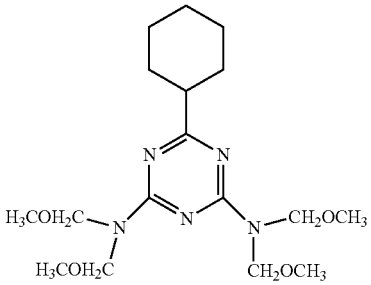
(C2-9)
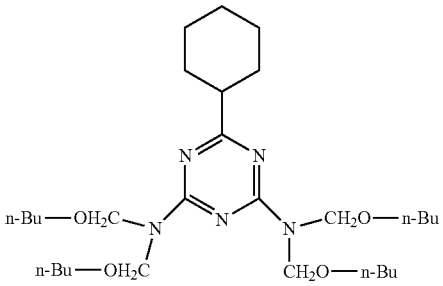
-continued
(C2-10)
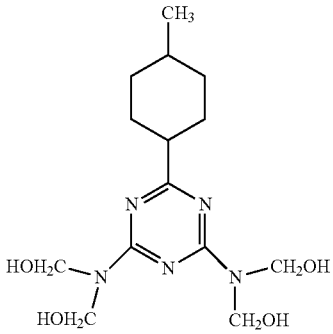
(C2-11)
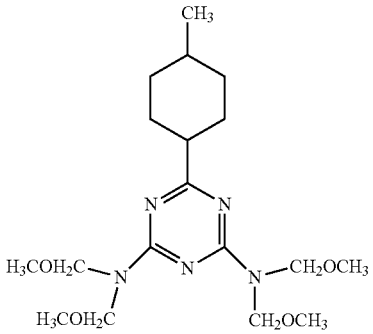
(C2-12)
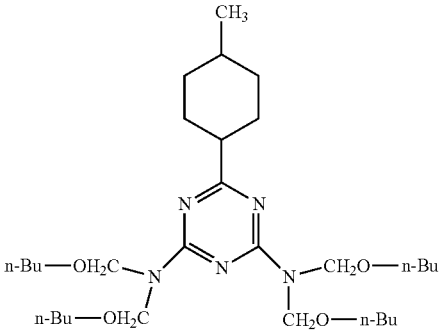
(C2-13)
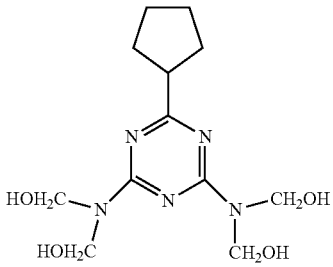
(C2-14)
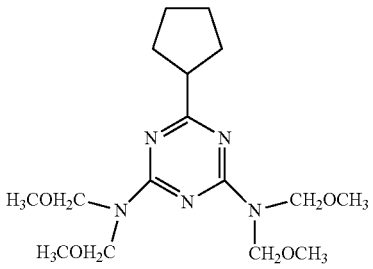

-continued
(C2-15)
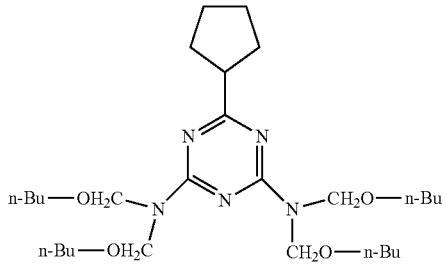
(C2-16)
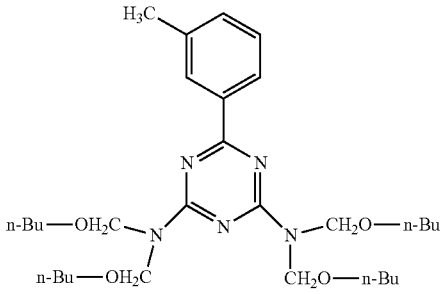
(C2-17)
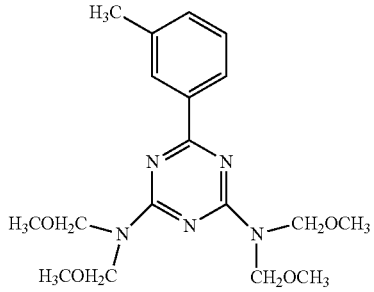
(C2-18)
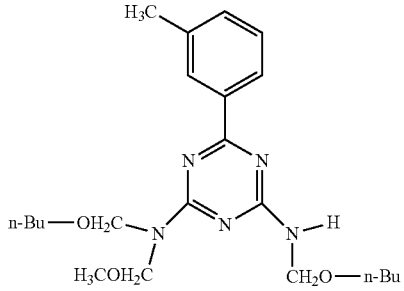
Specific examples of compounds represented by Formula (C3) will be illustrated below:
(C3-1)
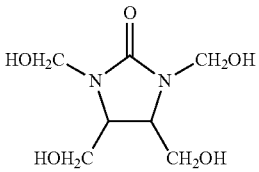
-continued
(C3-2)
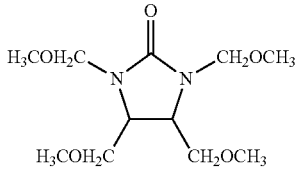
(C3-3)
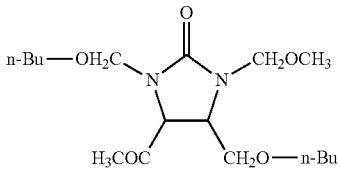
(C3-4)
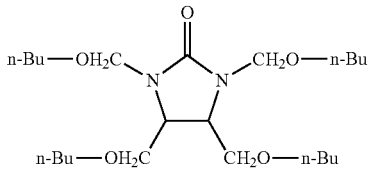
(C3-5)
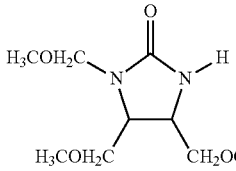
(C3-6)
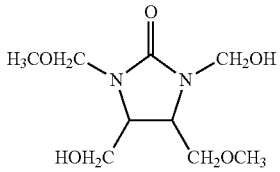
Specific examples of compounds represented by Formula (C4) will be illustrated below:
(C4-1)
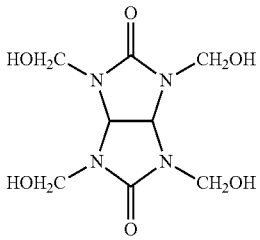
(C4-2)
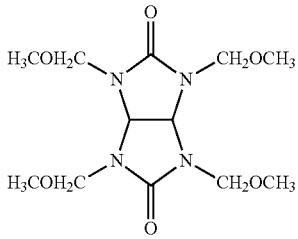

-continued (C4-3)

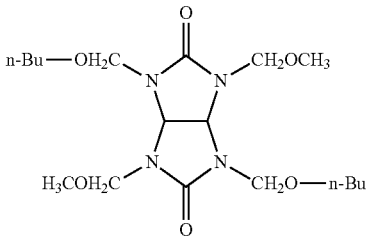

(C4-4)

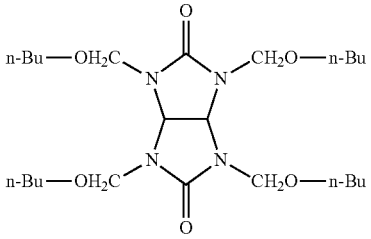

(C4-5)

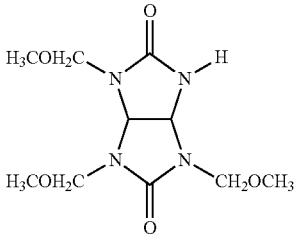

(C4-6)

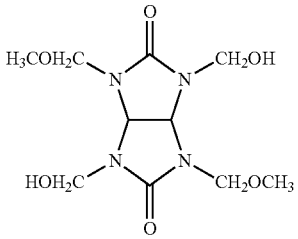

Specific examples of compounds represented by Formula (C5) will be illustrated below:

(C5-1)

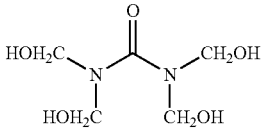

(C5-2)

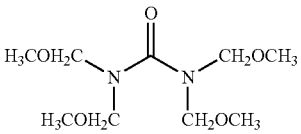

(C5-3)

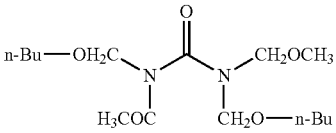

-continued (C5-4)

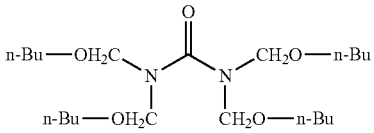

(C5-5)

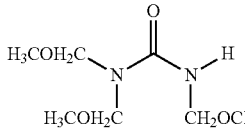

(C5-6)

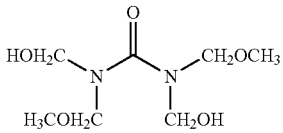

Next, a thermoplastic resin having a polymerizable functional group will be described. The thermoplastic resin having a polymerizable functional group can have a structural unit represented by Formula (D) illustrated below:

(D)

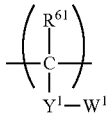

where $R^{61}$ represents a hydrogen atom or an alkyl group; $Y^1$ represents a single bond, an alkylene group or a phenylene group; and $W^1$ represents a hydroxy group, a thiol group, an amino group, a carboxyl group or a methoxy group.

Examples of the thermoplastic resin having a structural unit represented by Formula (D) include acetal resins, polyolefin resins, polyester resins, polyether resins, and polyamide resins. These resins further have the following characteristic structures in addition to the structural unit represented by Formula (D). The characteristic structures (E-1) to (E-6) are illustrated below. Acetal resin has a structural unit (E-1). Polyolefin resin has a structural unit (E-2). Polyester resin has a structural unit (E-3). Polyether resin has a structural unit (E-4). Polyamide resin has a structural unit (E-5). Cellulose resin has a structural unit (E-6).

(E-1)

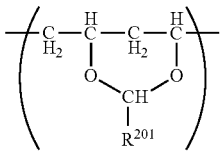

(E-2)

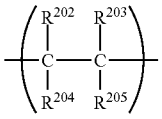

(E-3)

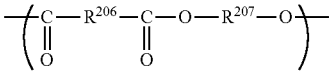

-continued (E-4)

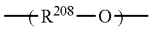

(E-5)

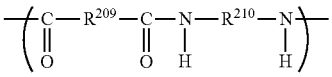

(E-6)

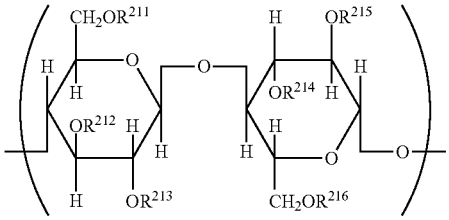

where $R^{201}$ to $R^{205}$ each independently represent a substituted or unsubstituted alkyl group or a substituted or unsubstituted aryl group; $R^{206}$ to $R^{210}$ each independently represent a substituted or unsubstituted alkylene group or a substituted or unsubstituted arylene group; when $R^{201}$ is $C_3H_7$ (propyl group), the characteristic structure (E-1) is butyral; and $R^{211}$ to $R^{216}$ represent an acetyl group, a hydroxyethyl group, a hydroxypropyl group or a hydrogen atom.

The resin having a structural unit represented by Formula (D) (hereinafter also referred to as Resin D) can be prepared by polymerization of a monomer having a polymerizable functional group (a hydroxy group, a thiol group, an amino group, a carboxyl group or a methoxy group) available from Sigma-Aldrich Japan K.K. or Tokyo Chemical Industry Co., Ltd.

Resin D is also usually commercially available. Examples of such commercially available resins include polyether polyol resins such as AQD-457 and AQD-473 manufactured by Nippon Polyurethane Industry Co., Ltd. and SUNNIXs GP-400 and GP-700 manufactured by Sanyo Chemical Industries, Ltd.; polyester polyol resins such as PHTHALKYD W2343 manufactured by Hitachi Chemical Co., Ltd., WATERSOLs S-118 and CD-520 and BECKOLITEs M-6402-50 and M-6201-40 IM manufactured by DIC Corporation, HARIDIP WH-1188 manufactured by Harima Chemicals Group, Inc., and ES3604 and ES6538 manufactured by Japan U-pica, Co., Ltd.; polyacrylic polyol resins such as BURNOCKs WE-300 and WE-304 manufactured by DIC Corporation; polyvinyl alcohol resins such as KURARAY POVAL PVA-203 manufactured by Kuraray Co., Ltd.; polyvinyl acetal resins such as BX-1 and BM-1 manufactured by Sekisui Chemical Co., Ltd.; polyamide resins such as TORESIN FS-350 manufactured by Nagase ChemteX Corporation; carboxyl group-containing resins such as AQUALIC manufactured by Nippon Shokubai CO., LTD. and FINELEX SG2000 manufactured by Namariichi Co., Ltd.; polyamine resins such as LUCKAMIDE manufactured by DIC Corporation; and polythiol resins such as QE-340M manufactured by Toray Industries, Inc. Among these, polyvinyl acetal resins and polyester polyol resins can more preferably be used from the viewpoint of polymerizability and the uniformity of the undercoat layer.

Resin D can have a weight average molecular weight (Mw) of 5,000 to 400,000.

Examples of a method of quantitatively determining the polymerizable functional group in the resin include titration of the carboxyl group with potassium hydroxide, titration of the amino group with sodium nitrite, titration of the hydroxyl group with acetic anhydride and potassium hydroxide, and titration of the thiol group with 5,5'-dithiobis (2-nitrobenzoic acid). Examples thereof also include a calibration curve method from IR spectra of samples having different ratios of the polymerizable functional group to be introduced.

Specific examples of Resin D are shown in Table 12 below. In Table 12, Column "Characteristic moiety " indicates a structural unit represented by one of (E-1) to (E-6).

TABLE 12

| | Structure | | | Molar number of functional | Characteristic | Substituent in characteristic | Molecular |
|---|---|---|---|---|---|---|---|
| | $R^{61}$ | $Y^1$ | $W^1$ | group/g | moiety | moiety | weight |
| D1 | H | Single bond | OH | 3.3 mmol | Butyral | $R^{201} = C_3H_7$ | $1 \times 10^5$ |
| D2 | H | Single bond | OH | 3.3 mmol | Butyral | $R^{201} = C_3H_7$ | $4 \times 10^4$ |
| D3 | H | Single bond | OH | 3.3 mmol | Butyral | $R^{201} = C_3H_7$ | $2 \times 10^4$ |
| D4 | H | Single bond | OH | 1.0 mmol | Polyolefin | $R^{202}$ to $R^{205} = H$ | $1 \times 10^5$ |
| D5 | H | Single bond | OH | 3.0 mmol | Polyester | $R^{206} = R^{207} = C_2H_4$ | $8 \times 10^4$ |
| D6 | H | Single bond | OH | 2.5 mmol | Polyether | $R^{208} = C_4H_8$ | $5 \times 10^4$ |
| D7 | H | Single bond | OH | 2.1 mmol | Polyether | $R^{208} = C_4H_8$ | $2 \times 10^5$ |
| D8 | H | Single bond | COOH | 3.5 mmol | Polyolefin | $R^{202}$ to $R^{205} = H$ | $6 \times 10^4$ |
| D9 | H | Single bond | $NH_2$ | 1.2 mmol | Polyamide | $R^{209} = C_{10}H_{20}$, $R^{210} = C_6H_{12}$ | $2 \times 10^5$ |
| D10 | H | Single bond | SH | 1.3 mmol | Polyolefin | $R^{202}$ to $R^{205} = H$ | $9 \times 10^3$ |
| D11 | H | Phenylene | OH | 2.8 mmol | Polyolefin | $R^{202}$ to $R^{205} = H$ | $4 \times 10^3$ |
| D12 | H | Single bond | OH | 3.0 mmol | Butyral | $R^{201} = C_3H_7$ | $7 \times 10^4$ |
| D13 | H | Single bond | OH | 2.9 mmol | Polyester | $R^{206} = Ph$, $R^{207} = C_2H_4$ | $2 \times 10^4$ |
| D14 | H | Single bond | OH | 2.5 mmol | Polyester | $R^{206} = R^{207} = C_2H_4$ | $6 \times 10^3$ |
| D15 | H | Single bond | OH | 2.7 mmol | Polyester | $R^{206} = R^{207} = C_2H_4$ | $8 \times 10^4$ |
| D16 | H | Single bond | COOH | 1.4 mmol | Polyolefin | $R^{202}$ to $R^{204} = H$, $R^{205} = CH_3$ | $2 \times 10^5$ |
| D17 | H | Single bond | COOH | 2.2 mmol | Polyester | $R^{206} = Ph$, $R^{207} = C_2H_4$ | $9 \times 10^3$ |
| D18 | H | Single bond | COOH | 2.8 mmol | Polyester | $R^{206} = R^{207} = C_2H_4$ | $8 \times 10^2$ |
| D19 | $CH_3$ | $CH_2$ | OH | 1.5 mmol | Polyester | $R^{206} = R^{207} = C_2H_4$ | $2 \times 10^4$ |
| D20 | $C_2H_5$ | $CH_2$ | OH | 2.1 mmol | Polyester | $R^{206} = R^{207} = C_2H_4$ | $1 \times 10^4$ |
| D21 | $C_2H_5$ | $CH_2$ | OH | 3.0 mmol | Polyester | $R^{206} = R^{207} = C_2H_4$ | $5 \times 10^4$ |
| D22 | H | Single bond | $OCH_3$ | 2.8 mmol | Polyolefin | $R^{202}$ to $R^{205} = H$ | $7 \times 10^3$ |
| D23 | H | Single bond | OH | 3.3 mmol | Butyral | $R^{201} = C_3H_7$ | $2.7 \times 10^5$ |
| D24 | H | Single bond | OH | 3.3 mmol | Butyral | $R^{201} = C_3H_7$ | $4 \times 10^5$ |

TABLE 12-continued

| | Structure | | | Molar number of functional | Characteristic | Substituent in characteristic | Molecular |
|---|---|---|---|---|---|---|---|
| | $R^{61}$ | $Y^1$ | $W^1$ | group/g | moiety | moiety | weight |
| D25 | H | Single bond | OH | 2.5 mmol | Acetal | $R^{201}$ = H | $3.4 \times 10^5$ |
| D26 | H | Single bond | OH | 2.8 mmol | Cellulose | $R^{211}$ = $R^{216}$ = COCH3, $R^{212}$ to $R^{215}$ = H | $3 \times 10^4$ |

The resin particles in the present invention form protrusions at the interface between the undercoat layer and the charge generating layer. Kinds of the resin particles include, but should not be limited to, silicone resin particles, crosslink polymethyl methacrylate resin particles, styrene resin particles and fluorine resin particles. Silicone resin particles and crosslinking polymethyl methacrylate resin particles can more preferably be used because the protrusions are readily formed.

Examples of the method of dispersing resin particles include methods with homogenizers, ultrasonic dispersing machines, ball mills, sand mills, roll mills and vibration mills.

Formation of the protrusions of the undercoat layer can be checked by measuring the surface roughness. For the surface roughness, the ten-point average roughness Rzjis at a reference length of 0.8 mm is preferably 0.5 μm or more and 2.5 μm or less. The ten-point average roughness Rzjis within this range improves sensitivity and suppresses injection of charges from the support to the charge generating layer more significantly.

The number-average particle diameter of the resin particles is preferably 0.5 μm or more and 5 μm or less, more preferably 1.0 μm or more and 3.5 μm or less. The number-average particle diameter within this range improves sensitivity and suppresses injection of charges from the support to the charge generating layer more significantly.

The undercoat layer has a thickness of preferably 1 μm or more and 15 μm or less, more preferably 2 μm or more and 10 μm or less because the polymerized product is readily formed.

[Charge Generating Layer]

A charge generating layer is provided directly on the undercoat layer.

Examples of the charge generating substance include azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments such as metal phthalocyanine and non-metal phthalocyanine, and bisbenzimidazole derivatives. Among these, azo pigments or phthalocyanine pigments can more preferably be used. Among these phthalocyanine pigments, oxytitanium phthalocyanine, chlorogallium phthalocyanine and hydroxygallium phthalocyanine can more preferably be used.

Oxytitanium phthalocyanine can be the following. Examples thereof include oxytitanium phthalocyanine crystals having peaks at Bragg angles (2θ±0.2°) of 9.0°, 14.2°, 23.9° and 27.1° in CuKα characteristic X ray diffraction. Also, oxytitanium phthalocyanine crystals having peaks at Bragg angles (2θ±0.2°) of 9.5°, 9.7°, 11.7°, 15.0°, 23.5°, 24.1° and 27.3° are preferable.

Chlorogallium phthalocyanine can be the following. Examples thereof include chlorogallium phthalocyanine crystals having peaks at Bragg angles (2θ±0.2°) of 7.4°, 16.6°, 25.5° and 28.2° in CuKα characteristic X ray diffraction. Examples thereof also include chlorogallium phthalocyanine crystals having peaks at Bragg angles (2θ±0.2°) of 6.8°, 17.3°, 23.6° and 26.9°. Examples thereof further include chlorogallium phthalocyanine crystals having peaks at Bragg angles (2θ±0.2°) of 8.7°, 9.2°, 17.6°, 24.0°, 27.4° and 28.8°.

Hydroxy gallium phthalocyanine can be the following. Examples thereof include hydroxygallium phthalocyanine crystals having peaks at Bragg angles (2θ±0.2°) of 7.3°, 24.9° and 28.1° in CuKα characteristic X ray diffraction. Examples thereof also include hydroxygallium phthalocyanine crystals having peaks at Bragg angles (2θ±0.2°) of 7.5°, 9.9°, 12.5°, 16.3°, 18.6°, 25.1° and 28.3° in CuKα characteristic X ray diffraction.

Examples of the binder resin used in the charge generating layer include polymers and copolymers of vinyl compounds such as styrene, vinyl acetate, vinyl chloride, acrylic acid ester, methacrylic acid ester, vinylidene fluoride and trifluoroethylene; polyvinyl alcohol resins; polyvinyl acetal resins; polycarbonate resins; polyester resins; polysulfone resins; polyphenylene oxide resins; polyurethane resins; cellulose resins; phenol resins; melamine resins; silicon resins; and epoxy resins. Among these, polyester resins, polycarbonate resins and polyvinyl acetal resins are preferred, and polyvinyl acetal is more preferred.

In the charge generating layer, the mass ratio of the charge generating substance to the binder resin (charge generating substance/binder resin) is preferably 10/1 to 1/10, more preferably 5/1 to 1/5. Examples of a solvent used in the coating solution for a charge generating layer include alcohol solvents, sulfoxide solvents, ketone solvents, ether solvents, ester solvents or aromatic hydrocarbon solvents.

The thickness of the charge generating layer can be 0.05 μm or more and 5 μm or less.

[Hole Transporting Layer]

A hole transporting layer is formed on the charge generating layer.

Examples of the hole transport substance include polycyclic aromatic compounds, heterocycle compounds, hydrazone compounds, styryl compounds, benzidine compounds, triarylamine compounds and triphenylamine, or polymers having groups derived from these compounds in the main chain or the side chain. Among these, triarylamine compounds, benzidine compounds or styryl compounds can more preferably be used.

Examples of the binder resin used in the hole transporting layer include polyester resins, polycarbonate resins, polymethacrylic acid ester resins, polyarylate resins, polysulfone resins and polystyrene resins. Among these, polycarbonate resins and polyarylate resins can more preferably be used. These resins can have a weight average molecular weights (Mw) in the range of 10,000 to 300,000.

In the hole transporting layer, the mass ratio of the hole transport substance to the binder resin (hole transport substance/binder resin) is preferably 10/5 to 5/10, more preferably 10/8 to 6/10.

The hole transporting layer has a thickness of preferably 3 μm or more and 40 μm or less. The thickness is more preferably 5 μm or more and 16 μm or less from the viewpoint of the relation in thickness to the undercoat layer. Examples of the solvent used in the coating solution for a hole transporting layer include alcohol solvents, sulfoxide solvents, ketone solvents, ether solvents, ester solvents or aromatic hydrocarbon solvents.

A protective layer may be formed on the hole transporting layer. The surface protective layer contains a conductive particle or a charge transporting substance and a binder resin. The protective layer may further contain additives such as lubricants. Alternatively, the binder resin in the protective layer may have conductivity or charge transportability. In this case, no conductive particle or charge transporting substance in addition to the resin needs to be contained in the protective layer. The binder resin in the protective layer may be a thermoplastic resin, or may be a curable resin polymerized by heat, light or radiation (such as electron beams).

In a preferred method of forming layers constituting the electrophotographic photosensitive member such as the undercoat layer, the charge generating layer and the hole transporting layer, first, a material for each layer is dissolved and/or dispersed in a solvent to prepare a coating solution, and the resulting coating solution is applied to form a coating. Next, the resulting coating is dried and/or cured. Examples of the method of applying a coating solution include immersion coating, spray coating, curtain coating and spin coating. Among these, immersion coating can more preferably be used from the viewpoint of efficiency and productivity.

[Properties of Electrophotographic Photosensitive Member]

The electrophotographic photosensitive member according to the present invention desirably has small decay in the dark (dark decay). Specifically, when the electric-field intensity applied to the electrophotographic photosensitive member is 25 V/μm, the surface potential ($Vd_{1.0}$) 1.0 second after charging of the electrophotographic photosensitive member can be 95% or more of the surface potential ($Vd_{0.1}$) 0.1 seconds after charging of the electrophotographic photosensitive member. It is suggested that a $Vd_{1.0}$ of 95% or more sufficiently suppresses injection of charges from the support to the charge generating layer.

Any evaluation machine can be used, and a commercially available drum tester can be used.

In the evaluation method, first, a charger is set so that as the surface potential 0.1 seconds after charging of the electrophotographic photosensitive member, the electric-field intensity is 25 V/μm with respect to the total thickness of the undercoat layer, the charge generating layer, the hole transporting layer and optionally a protective layer. Next, the electrophotographic photosensitive member is charged under this setting condition to measure the surface potential 0.1 seconds after charging of the electrophotographic photosensitive member and the surface potential 1.0 second after charging of the electrophotographic photosensitive member, and a reduction rate of the surface potential 1.0 second after charging of the electrophotographic photosensitive member relative to the surface potential 0.1 seconds after charging of the electrophotographic photosensitive member is calculated.

[Process Cartridge and Electrophotographic Apparatus]

Figure 2:
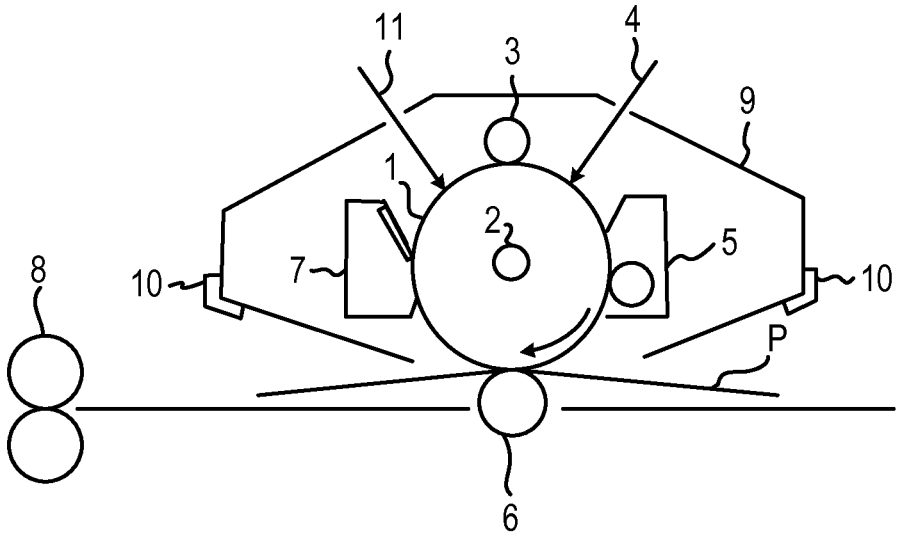
FIG. 2 is a diagram showing a schematic configuration of an electrophotographic apparatus including a process cartridge provided with the electrophotographic photosensitive member.

FIG. 2 illustrates a schematic configuration of an electrophotographic apparatus including a process cartridge provided with the electrophotographic photosensitive member. In FIG. 2, a cylindrical electrophotographic photosensitive member 1 is driven by rotation about an axis 2 in the arrow direction at a predetermined circumferential speed. The surface (circumferential surface) of the electrophotographic photosensitive member 1 driven by rotation is uniformly charged by a charging device 3 (primary charging device such as a charging roller) to have a predetermined positive or negative potential. Next, the surface of the electrophotographic photosensitive member 1 receives exposing light 4 (image exposing light) from an image exposure device (not illustrated) by slit exposure, laser beam scanning exposure or the like. An electrostatic latent image is sequentially formed on the surface of the electrophotographic photosensitive member 1 in correspondence with the target image.

The electrostatic latent image formed on the surface of the electrophotographic photosensitive member 1 is developed by a toner contained in a developer in a developing device 5 to form a toner image. Next, the toner image formed and carried on the surface of the electrophotographic photosensitive member 1 is sequentially transferred onto a transfer material P (such as paper) by transfer bias from a transfer device 6 (such as a transfer roller). The transfer material P is extracted from a transfer material feeding device (not illustrated) in synchronization with the rotation of the electrophotographic photosensitive member 1, and is fed into a contact region between the electrophotographic photosensitive member 1 and the transfer device 6.

The transfer material P having a transferred toner image is separated from the surface of the electrophotographic photosensitive member 1, and is introduced into a fixing device 8 to fix the image. Thereby, an image-formed product (such as printed matters and copy) is printed out from the apparatus.

After transfer of the toner image, the surface of the electrophotographic photosensitive member 1 is cleaned by removing a transfer residual developer (toner) with a cleaning device 7 (such as a cleaning blade). Next, the surface of the electrophotographic photosensitive member 1 is discharged by pre-exposing light 11 from a pre-exposure device (not illustrated), and is repeatedly used in image formation. As illustrated in FIG. 2, pre-exposure is not always necessary when the charging device 3 is a contact charging device provided with a charging roller.

Several components selected from the electrophotographic photosensitive member 1, the charging device 3, the developing device 5, the transfer device 6 and the cleaning device 7 may be accommodated in a container to be integrally formed as a process cartridge. The process cartridge may be configured attachable to and detachable from the main body of an electrophotographic apparatus such as copiers and laser beam printers. In FIG. 2, the electrophotographic photosensitive member 1, the charging device 3, the developing device 5 and the cleaning device 7 are integrally supported to form a process cartridge 9, which is attachable to and detachable from the main body of an electrophotographic apparatus with a guiding device 10 such as a rail provided with the main body of the electrophotographic apparatus.

EXAMPLES (Synthesis Example)

Under room temperature, 1,4,5,8-naphthalenetetracarboxylic dianhydride (26.8 g, 100 mmol) and dimethylacetamide (150 ml) were placed in a 300 ml three-necked flask under a nitrogen stream. A mixture of butanolamine (8.9 g, 100 mmol) and dimethylacetamide (25 ml) was added dropwise to the solution under stirring. After dropping was completed, the solution was heated under reflux for 6 hours. After the reaction was completed, the container was cooled to condense the solution under reduced pressure. Ethyl acetate was added to the residue, and the residue was refined by silica gel column chromatography. The recovered product was further recrystallized with ethyl acetate/hexane to prepare a monoimide product (10.2 g) having a butanol structure introduced into one side of the product.

The monoimide product (6.8 g, 20 mmol), hydrazine monohydrate (1 g, 20 mmol), p-toluenesulfonic acid (10 mg) and toluene (50 ml) were placed in a 300 ml three-necked flask, and the solution was heated under reflux for 5 hours. After the reaction was completed, the container was cooled to condense the solution under reduced pressure. The residue was refined by silica gel column chromatography. The recovered product was further recrystallized with toluene/ethyl acetate to prepare an electron transporting substance (2.54 g) represented by Formula (A1101).

number-average particle diameter: 2 μm) (1.5 parts) were added, and were stirred to prepare a coating solution for an undercoat layer. The coating solution for an undercoat layer was applied onto the support by immersion coating. The resulting coating was heated for 40 minutes at 160° C. to be polymerized to form an undercoat layer having a thickness of 4 μm. The content of the electron transporting substance was 41% by mass based on the total mass of the electron transporting substance, the crosslinking agent and the resin (the total mass of the composition).

The content of the resin particles was 15% by mass based on the total mass of the electron transporting substance, the crosslinking agent and the resin (the total mass of the composition).

Next, hydroxygallium phthalocyanine crystals (charge generating substance) (10 parts) having peaks at Bragg angles (2η±0.2°) of 7.5°, 9.9°, 12.5°, 16.3°, 18.6°, 25.1° and 28.3° in CuKα characteristic X ray diffraction, a compound represented by Formula (17) illustrated below (0.1 parts), polyvinyl butyral (trade name: S-LEC BX-1, manufactured by Sekisui Chemical Co., Ltd.) (5 parts) and cyclohexanone (250 parts) were placed in a sand mill with glass beads having a diameter of 0.8 mm, and were dispersed for 1.5 hours. Next, ethyl acetate (250 parts) was added to the solution to prepare a coating solution for a charge generating layer.

(17)

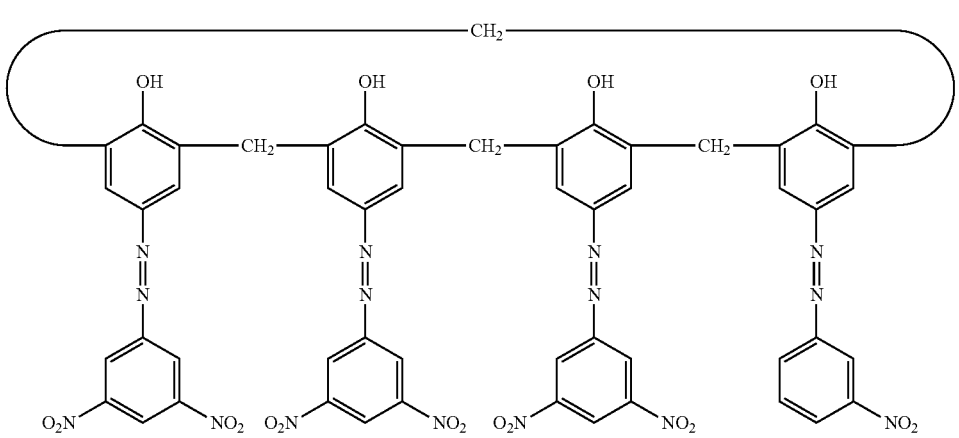

Next, production and evaluation of the electrophotographic photosensitive member will be described. The term "parts" indicates "parts by mass" in Examples.

Example 1

An aluminum cylinder having a diameter of 30 mm (JIS-A3003, aluminum alloy) was honed and washed with water using ultrasonics to prepare a support (conductive support).

Next, Electron transporting substance (A101) (4 parts), Crosslinking agent (B1:protecting group (H1))=5.1:2.2 (mass ratio)) (5.5 parts), Resin (D1) (in Formula (E-1), $R^{201}$ is $C_3H_7$) (0.3 parts) and dioctyltin laurate (0.05 parts) as a catalyst were dissolved in a mixed solvent of dimethylacetamide (50 parts) and methyl ethyl ketone (50 parts). Silicone resin particles (trade name: TOSPEARL 120, manufactured by Momentive Performance Materials Inc., The coating solution for a charge generating layer was applied onto an undercoat layer by immersion coating. The resulting coating was dried for 10 minutes at 100° C. to form a charge generating layer having a thickness of 0.15 μm.

Next, a triarylamine compound represented by Formula (9-1) (4 parts), a benzidine compound represented by Formula (9-2) (4 parts) and bisphenol Z polycarbonate (trade name: Z400, manufactured by Mitsubishi Engineering-Plastics Corporation) (10 parts) were dissolved in a mixed solvent of dimethoxymethane (40 parts) and chlorobenzene (60 parts) to prepare a coating solution for a hole transporting layer. The coating solution for a hole transporting layer was applied onto the charge generating layer by immersion coating. The resulting coating was dried for 40 minutes at 120° C. to form a hole transporting layer having a thickness of 15 μm.

(9-1)

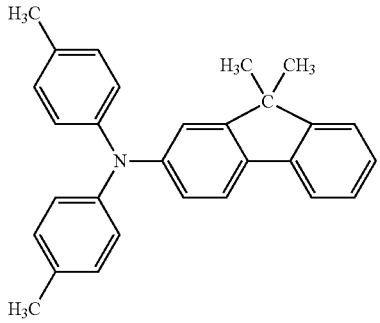

(9-2)

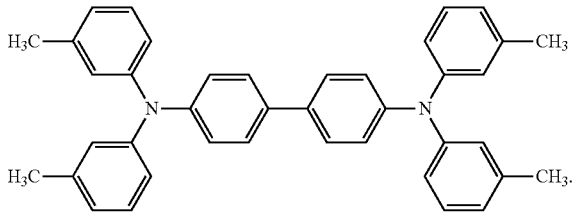

An electrophotographic photosensitive member for evaluation of potential was thus produced. A sample having an undercoat layer in the same procedure as above was prepared as a sample for measurement of surface roughness.

The potential of the electrophotographic photosensitive member thus prepared was evaluated, and the surface roughness thereof was measured in an normal temperature and normal humidity (23° C./50% RH) environment. The results are shown in Table 13.

(Evaluation on Surface Roughness of Undercoat Layer)

The surface of the sample (undercoat layer) for evaluation of surface roughness was measured with a surface roughness measurement apparatus (SURFCORDER SE-3400, manufactured by Kosaka Laboratory Ltd.). The surface roughness was measured according to Evaluation of Ten-Point Average Roughness (Rzjis) described in JIS B 0601:2001 at a reference length of 0.8 mm. Rzjis was 1.7 μm.

(Evaluation of Dark Decay)

The dark decay was measured with a drum tester CYNTHIA 90 manufactured by Gentec K.K. Charging was performed with a corona charger.

First, the charger was set. The charger was set such that the surface potential ($Vd_{0.1}$) 0.1 seconds after charging of the electrophotographic photosensitive member was 479 V (electric-field intensity was 25 V/μm). In Example 1, the total thickness of the undercoat layer, the charge generating layer and the hole transporting layer is 19.15 μm, and then the surface potential of the photosensitive member is set to 479 V to set the electric-field intensity to 25 V/μm.

The electrophotographic photosensitive member was charged again with the charger on the above setting condition to measure the surface potential ($Vd_{0.1}$) 0.1 seconds after charging of the electrophotographic photosensitive member and the surface potential ($Vd_{1.0}$) 1.0 second after charging of the electrophotographic photosensitive member. $Vd_{0.1}$ was 479 V, and $Vd_{1.0}$ was 474 V. When the electric-field intensity applied to the electrophotographic photosensitive member was 25 V/μm, the surface potential 1.0 second after charging of the electrophotographic photosensitive member was 99% of the surface potential 0.1 seconds after charging of the electrophotographic photosensitive member.

(Evaluation on Sensitivity)

Evaluation on sensitivity was determined according to the light-area potential in irradiation with light of the same intensity. Evaluation can be performed on the criteria: A lower light-area potential indicates higher sensitivity, and a higher light-area potential indicates lower sensitivity. The evaluations were performed with a modified laser beam printer manufactured by Canon Inc. (trade name: LBP-2510) such that the amount of exposing light was variable.

The surface potential of the electrophotographic photosensitive member was measured by extracting a developing cartridge from an evaluation machine and installing a potential measurement apparatus instead of the developing cartridge. The potential measurement apparatus was provided with a probe for measuring potential at a developing position of the developing cartridge. The probe for measuring potential was located at the center of the electrophotographic photosensitive member in the drum axis direction.

The electrophotographic photosensitive member was charged such that the dark-area potential (Vd) was −700 V, and the light-area potential (Vl) was measured at an intensity of 0.3 μJ/cm$^2$. The light-area potential (Vl) was −173 V.

Examples 2 to 28

Electrophotographic photosensitive members were produced in the same manner as in Example 1 except that the electron transporting substance and the resin of the undercoat layer were replaced with electron transporting substances and resins shown in Table 13, and were evaluated in the same manner. The results are shown in Table 13.

Example 29

An electrophotographic photosensitive member was produced in the same manner as in Example 1 except that an undercoat layer was formed in the manner described below, and was evaluated in the same manner. The results are shown in Table 13.

Electron transporting substance (A101) (4 parts), Crosslinking agent (B1:protecting group (H1)=5.1:2.2 (mass ratio)) (5.5 parts), Resin (D1) (0.3 parts) and dioctyltin laurate (0.5 parts) as a catalyst were dissolved in a mixed solvent of dimethylacetamide (50 parts) and methyl ethyl ketone (50 parts). Crosslinked polymethyl methacrylate (PMMA) particles (trade name: TECHPOLYMER SSX-102, manufactured by Sekisui Plastics Co., Ltd., number-average particle diameter of 2 μm) (2.0 parts) were added with stirring to prepare a coating solution for an undercoat layer. The coating solution for an undercoat layer was applied onto a support by immersion coating. The resulting coating was heated for 40 minutes at 160° C. to be polymerized to form an undercoat layer having a thickness of 5 μm.

Examples 30 to 48

Electrophotographic photosensitive members were produced in the same manner as in Example 1 except that the electron transporting substance, the crosslinking agent and the resin of the undercoat layer were replaced with electron transporting substances, crosslinking agents and resins as shown in Table 13, and were evaluated in the same manner. The results are shown in Table 13.

The characteristic structures (E-1 to E-5) of D3, D5, D18 and D21 are specifically shown below.

D3: in Formula (E-1), $R^{201}$ is a propyl group.

D5: in Formula (E-3), $R^{206}$ is $(CH_2)_6$, and $R^{207}$ is $CH_2C(CH_3)_2CH_2$.

D18: in Formula (E-3), $R^{206}$ is $(CH_2)_6$, and $R^{207}$ is $CH_2C(CH_3)_2CH_2$.

D21: in Formula (E-3), $R^{206}$ is $(CH_2)_6$, and $R^{207}$ is $CH_2C(CH_3)_2CH_2$.

Example 49

An electrophotographic photosensitive member was produced in the same manner as in Example 1 except that the undercoat layer was formed in the manner described below, and was evaluated in the same manner. The results are shown in Table 13.

Electron transporting substance (A114) (5.0 parts), Amine compound (C1-1) (1.75 parts), Resin (D1) (2.0 parts) and dodecylbenzenesulfonic acid (0.1 parts) as a catalyst were dissolved in a mixed solvent of dimethylacetamide (50 parts) and methyl ethyl ketone (50 parts). Crosslinked polymethyl methacrylate (PMMA) particles (TECHPOLYMER SSX-102, number-average particle diameter of 2 μm) (2.0 parts) were added with stirring to prepare a coating solution for an undercoat layer.

The coating solution for an undercoat layer was applied onto a support by immersion coating. The resulting coating was heated for 40 minutes at 160° C. to evaporate the solvent. At the same time, the coating was polymerized (cured) to form an undercoat layer having a thickness of 6 μm.

Example 50

An electrophotographic photosensitive member was produced in the same manner as in Example 49 except that Amine compound (C1-1) used in the undercoat layer was changed to (C1-3), and was evaluated in the same manner. The results are shown in Table 13.

Example 51

An electrophotographic photosensitive member was produced in the same manner as in Example 1 except that the undercoat layer was formed in the manner described below, and was evaluated in the same manner. The results are shown in Table 14.

Electron transporting substance (A101) (4 parts), Amine compound (C1-9) (4 parts), Resin (D1) (1.5 parts) and dodecylbenzenesulfonic acid (0.2 parts) as a catalyst were dissolved in a mixed solvent of dimethylacetamide (50 parts) and methyl ethyl ketone (50 parts). Silicone resin particles (TOSPEARL 120, number-average particle diameter of 2 μm) (1.5 parts) were added with stirring to prepare a coating solution for an undercoat layer. The coating solution for an undercoat layer was applied onto a support by immersion coating. The resulting coating was heated for 40 minutes at 160° C. to be polymerized to form an undercoat layer having a thickness of 6 μm.

Examples 52 and 53

An electrophotographic photosensitive member was prepared in the same manner as in Example 51 except that Crosslinking agent (C1-9) used in Example 51 was changed to the crosslinking agent shown in Table 14, and was evaluated in the same manner. The results are shown in Table 14.

Example 54

An electrophotographic photosensitive member was produced in the same manner as in Example 1 except that an undercoat layer was formed in the manner described below, and was evaluated in the same manner. The results are shown in Table 14.

Electron transporting substance (A101) (3.6 parts), Isocyanate compound (B1:protecting group (H1)=5.1:2.2 (mass ratio)) (7 parts), Resin (D1) (1.3 parts) and dioctyltin laurate (0.5 parts) as a catalyst were dissolved in a mixed solvent of dimethylacetamide (50 parts) and methyl ethyl ketone (50 parts). Silicone resin particles (TOSPEARL 120, number-average particle diameter of 2 μm) (1.5 parts) were added with stirring to prepare a coating solution for an undercoat layer. The coating solution for an undercoat layer was applied onto a support by immersion coating. The resulting coating was heated for 40 minutes at 160° C. to be polymerized to form an undercoat layer having a thickness of 4 μm.

Example 55

An electrophotographic photosensitive member was produced in the same manner as in Example 1 except that an undercoat layer was formed in the manner described below, and was evaluated in the same manner. The results are shown in Table 14.

Next, Electron transporting substance (A101) (4 parts), Crosslinking agent (B1:protecting group (H1)=5.1:2.2 (mass ratio)) (7.3 parts), Resin (D1) (0.9 parts) and dioctyltin laurate (0.5 parts) as a catalyst were dissolved in a mixed solvent of dimethylacetamide (50 parts) and methyl ethyl ketone (50 parts). Silicone resin particles (TOSPEARL 120, number-average particle diameter of 2 μm) (1.5 parts) were added with stirring to prepare a coating solution for an undercoat layer. The coating solution for an undercoat layer was applied onto a support by immersion coating. The resulting coating was heated for 40 minutes at 160° C. to be polymerized to form an undercoat layer having a thickness of 4 μm.

Example 56

An electrophotographic photosensitive member was produced in the same manner as in Example 1 except that an undercoat layer was formed in the manner described below, and was evaluated in the same manner. The results are shown in Table 14.

Electron transporting substance (A114) (6 parts), Amine compound (C1-3) (2.1 parts), Resin (D1) (0.5 parts) and dodecylbenzenesulfonic acid (0.1 parts) as a catalyst were dissolved in a mixed solvent of dimethylacetamide (50 parts) and methyl ethyl ketone (50 parts). Silicone resin particles (TOSPEARL 120, number-average particle diameter of 2 μm) (1.5 parts) were added with stirring to prepare a coating solution for an undercoat layer. The coating solution for an undercoat layer was applied onto a support by immersion coating. The resulting coating was heated for 40 minutes at 160° C. to be polymerized to form an undercoat layer having a thickness of 4 μm.

Examples 57 to 60

The content of the silicone resin particles of the undercoat layer in Example 1 was changed from 1.5 parts to 1.0 part, 0.75 parts, 0.5 parts and 0.3 parts. Except for these, electrophotographic photosensitive members were produced in the same manner as in Example 1, and were evaluated in the same manner. The results are shown in Table 14.

Example 61

The silicone resin particles (TOSPEARL 120) of the undercoat layer in Example 1 were replaced with crosslinked polymethyl methacrylate (PMMA) particles (trade name: TAFTIC FH-S, manufactured by TOYOBO CO., LTD., number-average particle diameter of 0.5 μm). Except for that, an electrophotographic photosensitive member was produced in the same manner as in Example 1, and was evaluated in the same manner. The results are shown in Table 14.

Example 62

The silicone resin particles (TOSPEARL 120) of the undercoat layer in Example 1 were replaced with crosslinked polymethyl methacrylate (PMMA) particles (trade name: TECHPOLYMER SSX-101, manufactured by Sekisui Plastics Co., Ltd., number-average particle diameter of 1 μm). Except for that, an electrophotographic photosensitive member was produced in the same manner as in Example 1, and was evaluated in the same manner. The results are shown in Table 14.

Example 63

An electrophotographic photosensitive member was produced in the same manner as in Example 29 except that the amount of the crosslinked polymethyl methacrylate (PMMA) particles in Example 29 was changed from 2.0 parts to 1.5 parts, and was evaluated in the same manner. The results are shown in Table 14.

Example 64

The silicone resin particles (TOSPEARL 120) of the undercoat layer in Example 1 were replaced with silicone resin particles (trade name: Tospearl 130, manufactured by Momentive Performance Materials Inc., number-average particle diameter of 3 μm). Except for that, an electrophotographic photosensitive member was produced in the same manner as in Example 1, and was evaluated in the same manner. The results are shown in Table 14.

Example 65

The silicone resin particles (TOSPEARL 120) of the undercoat layer in Example 1 were replaced with silicone resin particles (trade name: TOSPEARL 145, manufactured by Momentive Performance Materials Inc., number-average particle diameter of 4.5 μm). Except for that, an electrophotographic photosensitive member was produced in the same manner as in Example 1, and was evaluated in the same manner. The results are shown in Table 14.

Example 66

The silicone resin particles (TOSPEARL 120) of the undercoat layer in Example 1 were replaced with crosslinked polystyrene particles (trade name: CHEMISNOW SX, manufactured by Soken Chemical & Engineering Co., Ltd., number-average particle diameter of 3.5 μm). Except for that, an electrophotographic photosensitive member was produced in the same manner as in Example 1, and was evaluated in the same manner. The results are shown in Table 14.

Example 67

An electrophotographic photosensitive member was produced in the same manner as in Example 1 except that Resin (D1) of the undercoat layer in Example 1 was not added, and was evaluated in the same manner. The results are shown in Table 14.

Example 68

An electrophotographic photosensitive member was produced in the same manner as in Example 29 except that the thickness of the undercoat layer in Example 29 was changed from 5 μm to 7 μm and Resin (D1) was not added, and was evaluated in the same manner. The results are shown in Table 14.

Example 69

An electrophotographic photosensitive member was produced in the same manner as in Example 67 except that the amount of Electron transporting substance (A101) to be added in the undercoat layer in Example 67 was changed from 4 parts to 3 parts, and was evaluated in the same manner. The results are shown in Table 14.

Example 70

The amount of Crosslinking agent (B1:protecting group (H1)=5.1:2.2 (mass ratio)) to be added in the undercoat layer in Example 67 was changed from 5.5 parts to 3.5 parts. Except for that, an electrophotographic photosensitive member was produced in the same manner as in Example 67, and was evaluated in the same manner. The results are shown in Table 14.

Example 71

An electrophotographic photosensitive member was produced in the same manner as in Example 1 except that a charge generating layer was formed in the manner described below, and was evaluated in the same manner. The results are shown in Table 14.

Using oxytitanium phthalocyanine (10 parts) having peaks at Bragg angles (2θ±0.2°) of 9.0°, 14.2°, 23.9° and 27.1° in CuKα X ray diffraction, a polyvinyl butyral resin (trade name: S-LEC BX-1, manufactured by Sekisui Chemical Co., Ltd.) was dissolved in a mixed solvent of cyclohexanone:water=97:3 to prepare a 5% by mass solution (166 parts). The solution and a mixed solvent (150 parts) of cyclohexanone:water=97:3 were dispersed for 4 hours with 1 mmϕ glass beads (400 parts) in a sand mill. Then, a mixed solvent of cyclohexanone:water=97:3 (210 parts) and cyclohexanone (260 parts) were added to prepare a coating solution for a charge generating layer. The coating solution for a charge generating layer was applied onto an undercoat layer by immersion coating. The resulting coating was dried at 80° C. for 10 minutes to form a charge generating layer having a thickness of 0.20 μm.

Example 72

An electrophotographic photosensitive member was produced in the same manner as in Example 1 except that a charge generating layer was formed in the manner described below, and was evaluated in the same manner. The results are shown in Table 14.

A bisazo pigment represented by structural formula (11) (20 parts) and a polyvinyl butyral resin (trade name: S-LEC BX-1, manufactured by Sekisui Chemical Co., Ltd.) (10 parts) were mixed and dispersed in tetrahydrofuran (150 parts) to prepare a coating solution for a charge generating layer. The coating solution was applied onto the undercoat layer by immersion coating. The resulting coating was dried at 110° C. for 30 minutes to form a charge generating layer having a thickness of 0.30 μm.

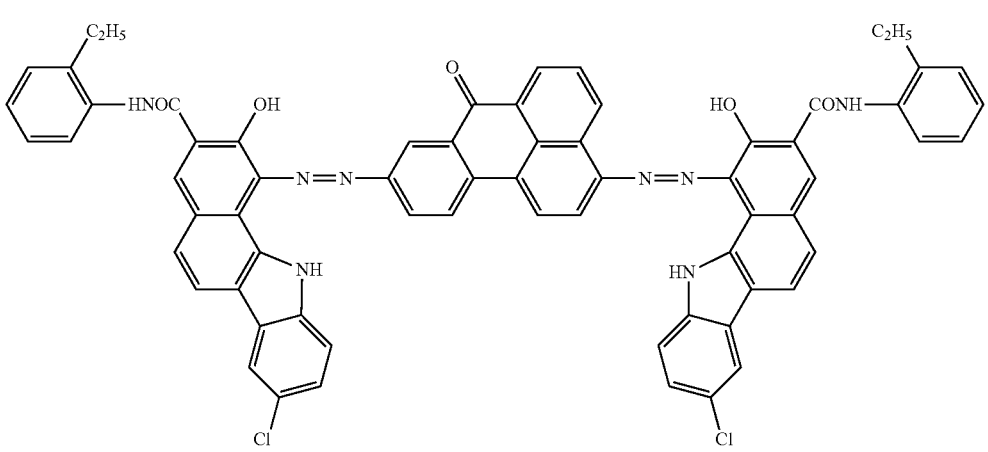

(11)

Example 73

The content of the crosslinked polymethyl methacrylate (PMMA) particles in the undercoat layer in Example 61 was changed from 1.5 parts to 0.3 parts, and the thickness was changed from 4 μm to 1 μm. Except for these, an electrophotographic photosensitive member was produced in the same manner as in Example 61, and was evaluated in the same manner. The results are shown in Table 14.

Example 74

An electrophotographic photosensitive member was produced in the same manner as in Example 1 except that the surface of an aluminum cylinder (JIS-A3003, aluminum alloy) having a diameter of 30 mm was subjected to anode oxidation, and was washed with water using ultrasonics to prepare a support (conductive support), and was evaluated in the same manner. The results are shown in Table 14.

Example 75

An electrophotographic photosensitive member was produced in the same manner as in Example 1 except that the surface of an aluminum cylinder (JIS-A3003, aluminum alloy) having a diameter of 30 mm was roughened by machining, and was washed with water using ultrasonics to prepare a support (conductive support), and was evaluated in the same manner. The results are shown in Table 14.

Comparative Example 1

An electrophotographic photosensitive member was produced in the same manner as in Example 67 except that the silicone resin particles of the undercoat layer in Example 67 were not added, and was evaluated in the same manner. The results are shown in Table 15.

Comparative Example 2

An electrophotographic photosensitive member was produced in the same manner as in Example 67 except that the amount of Electron transporting substance (A101) to be added in the undercoat layer in Example 67 was changed from 4 parts to 2 parts, and was evaluated in the same manner. The results are shown in Table 15.

Comparative Example 3

An electrophotographic photosensitive member was produced in the same manner as in Example 50 except that Resin (D1) of the undercoat layer in Example 50 was not added, and the 2.0 parts of crosslinked polymethyl methacrylate (PMMA) particles was changed to 1.5 parts of silicone resin particles (TOSPEARL 120), and was evaluated in the same manner. The results are shown in Table 15.

Comparative Example 4

An electrophotographic photosensitive member was produced in the same manner as in Example 1 except that an undercoat layer was formed in the manner described below, and was evaluated in the same manner. The results are shown in Table 15.

A compound represented by Formula (18) illustrated below (8 parts) and bisphenol Z polycarbonate (trade name: Z400, manufactured by Mitsubishi Engineering-Plastics Corporation) (10 parts) were dissolved in a mixed solvent of dimethoxymethane (40 parts) and chlorobenzene (60 parts) to prepare a coating solution for an undercoat layer. The coating solution for an undercoat layer was applied onto a support by immersion coating. The resulting coating was dried for 40 minutes at 120° C. to form an undercoat layer having a thickness of 5 μm.

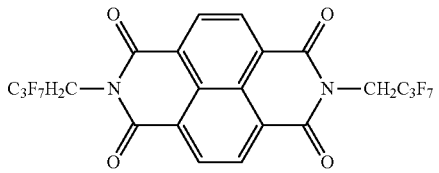

(18)

Comparative Example 5

An electrophotographic photosensitive member was produced in the same manner as in Example 1 except that an undercoat layer was formed in the manner described below, and was evaluated in the same manner. The results are shown in Table 15.

Zinc oxide (average particle size of 70 nm, manufactured by Tayca Corporation, specific surface area of 15 $m^2/g$) (100 parts) was mixed with tetrahydrofuran (500 parts) by stirring. A silane coupling agent (KBM603, manufactured by Shin-Etsu Chemical Co., Ltd.) (1.25 parts) was added, and was stirred for 2 hours. Subsequently, toluene was distilled off under reduced pressure, and the residue was burned at 120° C. for 3 hours to prepare a zinc oxide pigment surfaced-treated with a silane coupling agent.

The surface-treated zinc oxide pigment (6 parts) was mixed with a solution in which Electron transporting substance alizarin (A907) (0.1 parts), Isocyanate compound (B1:protecting group (H1)=5.1:2.2 (mass ratio)) (2 parts) and Resin (D1) (1.5 parts) were dissolved in a mixed solvent of dimethylacetamide (50 parts) and methyl ethyl ketone (50 parts). The surface-treated zinc oxide pigment was dispersed for 2 hours with 1 mm-diameter glass beads in a sand mill. Dioctyltin laurate (0.3 parts) as a catalyst and silicone resin particles (trade name: TOSPEARL 120, number-average particle diameter of 2 μm) (1.5 parts) were added to the resulting dispersion solution with stirring to prepare a coating solution for an undercoat layer. The coating solution for an undercoat layer was applied onto a support by immersion coating. The resulting coating was heated for 40 minutes at 160° C. to be polymerized to form an undercoat layer having a thickness of 4 μm.

TABLE 13

| | Undercoat layer | | | | | | | | | | | | |
|---|---|---|---|---|---|---|---|---|---|---|---|---|---|
| | | | | Composition | | | | | | | | | |
| | Resin particles | | | Type of electron | | | Amount of | Amount of electron transporting | Amount of resin particles/ | | Results of evaluation | | |
| Example | Type | Particle diameter (μm) | Amount (parts) | trans-porting substance | Cross-linking agent | Resin | composi-tion (parts) | substance/ composition (%) | amount of composition (%) | Thick-ness (μm) | Rzjis (μm) | Dark decay (%) | Vl (V) |
| 1 | Silicone resin | 2 | 1.5 | A101 | B1 | D1 | 9.8 | 41 | 15 | 4 | 1.7 | 99 | −173 |
| 2 | Silicone resin | 2 | 1.5 | A103 | B1 | D1 | 9.8 | 41 | 15 | 4 | 2 | 98 | −152 |
| 3 | Silicone resin | 2 | 1.5 | A104 | B1 | D1 | 9.8 | 41 | 15 | 4 | 2 | 97 | −172 |
| 4 | Silicone resin | 2 | 1.5 | A105 | B1 | D1 | 9.8 | 41 | 15 | 4 | 1.9 | 98 | −158 |
| 5 | Silicone resin | 2 | 1.5 | A108 | B1 | D1 | 9.8 | 41 | 15 | 4 | 1.7 | 99 | −168 |
| 6 | Silicone resin | 2 | 1.5 | A109 | B1 | D1 | 9.8 | 41 | 15 | 4 | 1.6 | 99 | −151 |
| 7 | Silicone resin | 2 | 1.5 | A110 | B1 | D1 | 9.8 | 41 | 15 | 4 | 1.6 | 99 | −168 |
| 8 | Silicone resin | 2 | 1.5 | A111 | B1 | D1 | 9.8 | 41 | 15 | 4 | 1.8 | 95 | −179 |
| 9 | Silicone resin | 2 | 1.5 | A112 | B1 | D1 | 9.8 | 41 | 15 | 4 | 1.7 | 98 | −172 |
| 10 | Silicone resin | 2 | 1.5 | A113 | B1 | D1 | 9.8 | 41 | 15 | 4 | 1.7 | 97 | −174 |
| 11 | Silicone resin | 2 | 1.5 | A114 | B1 | D1 | 9.8 | 41 | 15 | 4 | 2 | 98 | −164 |
| 12 | Silicone resin | 2 | 1.5 | A115 | B1 | D1 | 9.8 | 41 | 15 | 4 | 1.8 | 98 | −158 |
| 13 | Silicone resin | 2 | 1.5 | A116 | B1 | D1 | 9.8 | 41 | 15 | 4 | 2 | 99 | −168 |
| 14 | Silicone resin | 2 | 1.5 | A117 | B1 | D1 | 9.8 | 41 | 15 | 4 | 2 | 95 | −164 |
| 15 | Silicone resin | 2 | 1.5 | A201 | B1 | D1 | 9.8 | 41 | 15 | 4 | 1.7 | 95 | −171 |
| 16 | Silicone resin | 2 | 1.5 | A301 | B1 | D1 | 9.8 | 41 | 15 | 4 | 2 | 98 | −174 |
| 17 | Silicone resin | 2 | 1.5 | A401 | B1 | D1 | 9.8 | 41 | 15 | 4 | 1.9 | 98 | −161 |
| 18 | Silicone resin | 2 | 1.5 | A501 | B1 | D1 | 9.8 | 41 | 15 | 4 | 1.9 | 99 | −171 |
| 19 | Silicone resin | 2 | 1.5 | A601 | B1 | D1 | 9.8 | 41 | 15 | 4 | 1.9 | 97 | −156 |
| 20 | Silicone resin | 2 | 1.5 | A701 | B1 | D1 | 9.8 | 41 | 15 | 4 | 1.8 | 96 | −164 |
| 21 | Silicone resin | 2 | 1.5 | A801 | B1 | D1 | 9.8 | 41 | 15 | 4 | 1.6 | 97 | −179 |
| 22 | Silicone resin | 2 | 1.5 | A901 | B1 | D1 | 9.8 | 41 | 15 | 4 | 1.9 | 98 | −151 |
| 23 | Silicone resin | 2 | 1.5 | A1001 | B1 | D1 | 9.8 | 41 | 15 | 4 | 1.7 | 97 | −161 |
| 24 | Silicone resin | 2 | 1.5 | A1101 | B1 | D1 | 9.8 | 41 | 15 | 4 | 1.6 | 97 | −162 |

TABLE 13-continued

| | Undercoat layer | | | | | | | | | | | | |
|---|---|---|---|---|---|---|---|---|---|---|---|---|---|
| | | | | Composition | | | | | | | | | |
| | Resin particles | | | Type of electron | | | Amount of | Amount of electron transporting | Amount of resin particles/ | | Results of evaluation | | |
| Example | Type | Particle diameter (μm) | Amount (parts) | trans-porting substance | Cross-linking agent | Resin | composi-tion (parts) | substance/ composition (%) | amount of composition (%) | Thick-ness (μm) | Rzjis (μm) | Dark decay (%) | Vl (V) |
| 25 | Silicone resin | 2 | 1.5 | A101 | B1 | D3 | 9.8 | 41 | 15 | 4 | 1.6 | 95 | −156 |
| 26 | Silicone resin | 2 | 1.5 | A101 | B1 | D5 | 9.8 | 41 | 15 | 4 | 2 | 97 | −153 |
| 27 | Silicone resin | 2 | 1.5 | A101 | B1 | D18 | 9.8 | 41 | 15 | 4 | 1.9 | 99 | −151 |
| 28 | Silicone resin | 2 | 1.5 | A101 | B1 | D21 | 9.8 | 41 | 15 | 4 | 1.8 | 97 | −160 |
| 29 | PMMA | 2 | 2.0 | A101 | B1 | D1 | 9.8 | 41 | 20 | 5 | 2.5 | 96 | −175 |
| 30 | PMMA | 2 | 2.0 | A103 | B1 | D1 | 9.8 | 41 | 20 | 5 | 2.5 | 97 | −175 |
| 31 | PMMA | 2 | 2.0 | A114 | B1 | D1 | 9.8 | 41 | 20 | 5 | 2.3 | 95 | −155 |
| 32 | PMMA | 2 | 2.0 | A117 | B1 | D1 | 9.8 | 41 | 20 | 5 | 2.4 | 97 | −175 |
| 33 | PMMA | 2 | 2.0 | A201 | B1 | D1 | 9.8 | 41 | 20 | 5 | 2 | 97 | −152 |
| 34 | PMMA | 2 | 2.0 | A301 | B1 | D1 | 9.8 | 41 | 20 | 5 | 2.1 | 98 | −167 |
| 35 | PMMA | 2 | 2.0 | A401 | B1 | D1 | 9.8 | 41 | 20 | 5 | 2.3 | 99 | −179 |
| 36 | PMMA | 2 | 2.0 | A501 | B1 | D1 | 9.8 | 41 | 20 | 5 | 2.5 | 98 | −177 |
| 37 | PMMA | 2 | 2.0 | A601 | B1 | D1 | 9.8 | 41 | 20 | 5 | 2.1 | 96 | −165 |
| 38 | PMMA | 2 | 2.0 | A701 | B1 | D1 | 9.8 | 41 | 20 | 5 | 2 | 96 | −169 |
| 39 | PMMA | 2 | 2.0 | A801 | B1 | D1 | 9.8 | 41 | 20 | 5 | 2.1 | 99 | −176 |
| 40 | PMMA | 2 | 2.0 | A901 | B1 | D1 | 9.8 | 41 | 20 | 5 | 2.5 | 98 | −154 |
| 41 | PMMA | 2 | 2.0 | A1001 | B1 | D1 | 9.8 | 41 | 20 | 5 | 2.3 | 97 | −172 |
| 42 | PMMA | 2 | 2.0 | A1101 | B1 | D1 | 9.8 | 41 | 20 | 5 | 2.3 | 99 | −176 |
| 43 | PMMA | 2 | 2.0 | A101 | B1:H2 | D1 | 9.8 | 41 | 20 | 5 | 2.5 | 99 | −179 |
| 44 | PMMA | 2 | 2.0 | A101 | B1:H3 | D1 | 9.8 | 41 | 20 | 5 | 2.5 | 97 | −152 |
| 45 | PMMA | 2 | 2.0 | A101 | B4:H1 | D1 | 9.8 | 41 | 20 | 5 | 2.4 | 98 | −164 |
| 46 | PMMA | 2 | 2.0 | A101 | B5:H1 | D1 | 9.8 | 41 | 20 | 5 | 2.4 | 97 | −159 |
| 47 | PMMA | 2 | 2.0 | A101 | B7:H1 | D1 | 9.8 | 41 | 20 | 5 | 2.3 | 95 | −170 |
| 48 | PMMA | 2 | 2.0 | A101 | B12:H1 | D1 | 9.8 | 41 | 20 | 5 | 2 | 95 | −171 |
| 49 | PMMA | 2 | 2.0 | A114 | C1-1 | D1 | 8.75 | 57 | 23 | 6 | 2.7 | 91 | −168 |
| 50 | PMMA | 2 | 2.0 | A114 | C1-3 | D1 | 8.75 | 57 | 23 | 6 | 2.7 | 92 | −166 |

TABLE 14

| | Undercoat layer | | | | | | | | | | | | |
|---|---|---|---|---|---|---|---|---|---|---|---|---|---|
| | | | | Composition | | | | | | | | | |
| | Resin particles | | | Type of electron | | | Amount of | Amount of electron transporting | Amount of resin particles/ | | Results of evaluation | | |
| Example | Type | Particle diam-eter (μm) | Amount (parts) | trans-porting substance | Cross-linking agent | Resin | composi-tion (parts) | substance/ composition (%) | amount of composition (%) | Thick-ness (μm) | Rz (μm) | Dark decay (%) | Vl (V) |
| 51 | Silicone resin | 2 | 1.5 | A101 | C1-9 | D1 | 9.5 | 42 | 16 | 6 | 1.5 | 97 | −172 |
| 52 | Silicone resin | 2 | 1.5 | A101 | C2-1 | D1 | 9.5 | 42 | 16 | 6 | 1.6 | 98 | −158 |
| 53 | Silicone resin | 2 | 1.5 | A101 | C3-3 | D1 | 9.5 | 42 | 16 | 6 | 1.5 | 99 | −172 |
| 54 | Silicone resin | 2 | 1.5 | A101 | B1 | D1 | 11.9 | 30 | 13 | 4 | 1.7 | 96 | −151 |
| 55 | Silicone resin | 2 | 1.5 | A101 | B1 | D1 | 12.2 | 33 | 12 | 4 | 2.3 | 95 | −153 |
| 56 | Silicone resin | 2 | 1.5 | A114 | C1-3 | D1 | 8.6 | 70 | 17 | 4 | 2.5 | 96 | −155 |
| 57 | Silicone resin | 2 | 1 | A101 | B1 | D1 | 9.8 | 41 | 10 | 4 | 1.2 | 99 | −177 |
| 58 | Silicone resin | 2 | 0.75 | A101 | B1 | D1 | 9.8 | 41 | 8 | 4 | 0.7 | 95 | −166 |
| 59 | Silicone resin | 2 | 0.5 | A101 | B1 | D1 | 9.8 | 41 | 5 | 4 | 0.5 | 99 | −165 |

TABLE 14-continued

| | Undercoat layer | | | | | | | | | | | | |
|---|---|---|---|---|---|---|---|---|---|---|---|---|---|
| | | | | Composition | | | | | | | | | |
| | Resin particles | | | Type of electron | | | Amount of | Amount of electron transporting | Amount of resin particles/ | | Results of evaluation | | |
| Example | Type | Particle diameter (μm) | Amount (parts) | transporting substance | Cross-linking agent | Resin | composition (parts) | substance/composition (%) | amount of composition (%) | Thickness (μm) | Rz (μm) | Dark decay (%) | Vl (V) |
| 60 | Silicone resin | 2 | 0.3 | A101 | B1 | D1 | 9.8 | 41 | 3 | 4 | 0.4 | 98 | −220 |
| 61 | PMMA | 0.5 | 1.5 | A101 | B1 | D1 | 9.8 | 41 | 15 | 4 | 1 | 97 | −230 |
| 62 | PMMA | 1 | 1.5 | A101 | B1 | D1 | 9.8 | 41 | 15 | 4 | 1.3 | 99 | −190 |
| 63 | PMMA | 2 | 1.5 | A101 | B1 | D1 | 9.8 | 41 | 15 | 4 | 1.5 | 98 | −180 |
| 64 | Silicone resin | 3 | 1.5 | A101 | B1 | D1 | 9.8 | 41 | 15 | 4 | 2 | 95 | −160 |
| 65 | Silicone resin | 4.5 | 1.5 | A101 | B1 | D1 | 9.8 | 41 | 15 | 4 | 2.8 | 94 | −165 |
| 66 | Polystyrene | 3.5 | 1.5 | A101 | B1 | D1 | 9.8 | 41 | 15 | 4 | 3 | 93 | −180 |
| 67 | Silicone resin | 2 | 1.5 | A101 | B1 | None | 9.5 | 42 | 16 | 4 | 2.9 | 92 | −190 |
| 68 | PMMA | 2 | 1.5 | A101 | B1 | None | 9.5 | 42 | 16 | 7 | 2.6 | 94 | −200 |
| 69 | Silicone resin | 2 | 1.5 | A101 | B1 | None | 8.5 | 35 | 18 | 4 | 2.7 | 93 | −220 |
| 70 | Silicone resin | 2 | 1.5 | A101 | B1 | None | 7.5 | 53 | 20 | 4 | 2.5 | 97 | −180 |
| 71 | Silicone resin | 2 | 1.5 | A101 | B1 | D1 | 9.8 | 41 | 15 | 4 | 1.8 | 99 | −159 |
| 72 | Silicone resin | 2 | 1.5 | A101 | B1 | D1 | 9.8 | 41 | 15 | 4 | 1.8 | 98 | −167 |
| 73 | PMMA | 0.5 | 0.3 | A101 | B1 | D1 | 9.8 | 41 | 3 | 1 | 0.6 | 93 | −220 |
| 74 | Silicone resin | 2 | 1.5 | A101 | B1 | D1 | 9.8 | 41 | 15 | 4 | 1.4 | 99 | −175 |
| 75 | Silicone resin | 2 | 1.5 | A101 | B1 | D1 | 9.8 | 41 | 15 | 4 | 1.3 | 99 | −170 |

TABLE 15

| | Undercoat layer | | | | | | | | | | | | |
|---|---|---|---|---|---|---|---|---|---|---|---|---|---|
| | | | | Composition | | | | | | | | | |
| | Resin particles | | | Type of electron | | | Amount of | Amount of electron transporting | Amount of resin particles/ | | Results of evaluation | | |
| Example | Type | Particle diameter (μm) | Amount (parts) | transporting substance | Cross-linking agent | Resin | composition (parts) | substance/composition (%) | amount of composition (%) | Other components | Thickness (μm) | Rzjis (μm) | Dark decay (%) | Vl (V) |
| Comparative Example 1 | None | | | A101 | B1 | None | 9.5 | 41 | — | | 4 | 0.2 | 95 | −300 |
| Comparative Example 2 | Silicone resin | 2 | 1.5 | A101 | B1 | None | 7.5 | 27 | 20 | | 4 | 2.5 | 95 | −260 |
| Comparative Example 3 | Silicone resin | 2 | 1.5 | A114 | C1-3 | None | 6.75 | 74 | 22 | | 6 | 2.8 | 95 | −250 |
| Comparative Example 4 | | | | | | | | | | Compound represented by Formula (18)/polycarbonate | 4 | 0.2 | 90 | −450 |
| Comparative Example 5 | Silicone resin | 2 | 1.5 | A907 | B1 | D1 | 3.6 | 3 | 42 | Zinc oxide | 4 | 0.7 | 85 | −240 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270562, filed Dec. 26, 2013 and Japanese Patent Application No. 2014-246017, filed Dec. 4, 2014, which are hereby incorporated by reference herein in their entirety.

What is claimed is:

1. An electrophotographic photosensitive member comprising:

a support;

an undercoat layer formed on the support, the undercoat layer having a surface roughness of 0.5 to 2.5 μm in terms of ten-point average roughness Rzjis measured at a reference length of 0.8 mm, and comprising resin particles and a polymerized product of a composition comprising a crosslinking agent and an electron transporting substance having a polymerizable functional group;

a charge generating layer formed directly on the undercoat layer; and a hole transporting layer formed on the charge generating layer, wherein the content of the electron transporting substance is 30% by mass or more and 70% by mass or less based on the total mass of the composition, the resin particles comprise 5 to 20% by mass based on the total mass of the composition, and a plurality of protrusions derived from the resin particles in the undercoat layer is formed at an interface between the undercoat layer and the charge generating layer.

2. The electrophotographic photosensitive member according to claim 1, wherein the polymerizable functional group of the electron transporting substance is selected from the group consisting of a hydroxy group, a thiol group, an amino group, a carboxyl group and a methoxy group.

3. The electrophotographic photosensitive member according to claim 1, wherein the crosslinking agent is an isocyanate compound having an isocyanate group or a block isocyanate group or an amine compound having a N-methylol group or an alkyletherified N-methylol group.

4. The electrophotographic photosensitive member according to claim 1, wherein the composition for the undercoat layer further comprises a thermoplastic resin having a polymerizable functional group.

5. The electrophotographic photosensitive member according to claim 4, wherein the polymerizable functional group of the thermoplastic resin is selected from the group consisting of a hydroxy group, a thiol group, an amino group, a carboxyl group and a methoxy group.

6. The electrophotographic photosensitive member according to claim 1, wherein the resin particles have a number-average particle diameter of 1.0 to 3.5 μm.

7. The electrophotographic photosensitive member according to claim 1, wherein the resin particles are selected from the group consisting of crosslinked polymethyl methacrylate resin particles and silicone resin particles.

8. The electrophotographic photosensitive member according to claim 1, wherein a surface potential 1.0 second after charging of the electrophotographic photosensitive member is 95% or more of a surface potential 0.1 seconds after charging of the electrophotographic photosensitive member when an electric-field intensity applied to the electrophotographic photosensitive member is 25 V/μm.

9. A process cartridge comprising the electrophotographic photosensitive member according to claim 1 and at least one device selected from the group consisting of a charging device, a developing device and a cleaning device, the process cartridge being attachable to and detachable from an electrophotographic apparatus.

10. An electrophotographic apparatus comprising the electrophotographic photosensitive member according to claim 1, a charging device, an image exposure device, a developing device and a transfer device.

* * * * *